US006788271B1

(12) United States Patent
Koo et al.

(10) Patent No.: US 6,788,271 B1
(45) Date of Patent: Sep. 7, 2004

(54) HELICAL ANTENNA MANUFACTURING APPARATUS AND METHOD THEREOF

(75) Inventors: Ki-Duk Koo, Suwon (KR); Dong-Seok Chang, Kyungki-do (KR); Hyung-Jong Kim, Seoul (KR)

(73) Assignee: K-Cera, Inc., Kyungki-do (KR)

( * ) Notice: Subject to any disclaimer, the term of this patent is extended or adjusted under 35 U.S.C. 154(b) by 0 days.

(21) Appl. No.: 10/009,321

(22) PCT Filed: May 12, 2000

(86) PCT No.: PCT/KR00/00449

§ 371 (c)(1),
(2), (4) Date: Jan. 8, 2002

(87) PCT Pub. No.: WO00/70710

PCT Pub. Date: Nov. 23, 2000

(30) Foreign Application Priority Data

May 13, 1999 (KR) ..... 1999-17190
May 13, 1999 (KR) ..... 1999-17191
Feb. 17, 2000 (KR) ..... 2000-7613

(51) Int. Cl.[7] ..... H01Q 1/36
(52) U.S. Cl. ..... 343/895; 29/600
(58) Field of Search ..... 343/702, 872, 343/873, 895, 741, 742, 866, 867

(56) References Cited

U.S. PATENT DOCUMENTS 3,907,565 A * 9/1975 Burton et al. ..... 96/36.2
4,148,030 A * 4/1979 Foldes ..... 343/895
4,160,979 A * 7/1979 Drewett ..... 343/788
4,435,716 A * 3/1984 Zandbergen ..... 343/895
4,639,708 A 1/1987 Weatherly ..... 336/200
4,697,192 A * 9/1987 Hofer et al. ..... 343/895
4,843,404 A * 6/1989 Benge et al. ..... 343/895
5,134,422 A * 7/1992 Auriol ..... 343/895
5,255,005 A * 10/1993 Terret et al. ..... 343/895
5,479,182 A * 12/1995 Sydor ..... 343/895
5,818,398 A 10/1998 Tsuru et al. ..... 343/895
6,018,326 A * 1/2000 Rudisill ..... 343/895
6,219,902 B1 * 4/2001 Memmen et al. ..... 29/600
6,232,929 B1 * 5/2001 Ermutlu et al. ..... 343/895

FOREIGN PATENT DOCUMENTS

DE 19516889 11/1996 ..... H01Q/1/36
EP 0815949 6/1997
EP 0863570 3/1998
EP 917241 A 5/1999
EP 0983864 8/1999
GB 2311675 3/1997
GB 2328084 7/1998
JP 52-075438 6/1977 ..... G03D/13/08

(List continued on next page.)

*Primary Examiner*—Tho Phan
(74) *Attorney, Agent, or Firm*—Gifford, Krass, Groh, Sprinkle, Anderson & Citkowski, P.C.

(57) ABSTRACT

Disclosed is a helical antenna manufacturing apparatus and method. A controller controls a core driver and a roller driver to rotate a core and a roller according to an rpm which is pre-set according to diameters of the core and the roller, and controls the core driver to move the core in a longitudinal direction according to the moving speed which is set according to working frequency bands of the antenna. When the core and the roller are contacted, they are rotated in opposite directions, and as the roller is rotated, a paste in a paste box moves together with a surface of the core and is printed on the surface of the core. As the core is rotated and moved in the longitudinal direction, a helical line is formed on the core. Pitches of the helical line formed on the core is changed according to the moving speed of the core in the longitudinal direction, and the working frequency bands of the antenna are changed according to the pitches of the helical line. Also, a helical line unit including a plurality of helical lines having different pitches printed on the surface of the core can be formed by controlling the core driver to move the core in the longitudinal direction according to the moving speeds which are set for the respective steps according to the working frequency bands of the antenna.

20 Claims, 24 Drawing Sheets

FOREIGN PATENT DOCUMENTS

| | | | |
|---|---|---|---|
| JP | 54-140536 | 10/1979 | G03D/5/06 |
| JP | 55-072311 | 5/1980 | H01Q/5/02 |
| JP | 56-001509 | 1/1981 | H01F/15/00 |
| JP | 60-148102 | 8/1985 | H01F/17/02 |
| JP | 61-136216 | 6/1986 | H01G/1/005 |
| JP | 62-247514 | 10/1987 | H01F/41/04 |
| JP | 02-32512 | 2/1990 | H01F/41/04 |
| JP | 03-280625 | 12/1991 | H04B/1/08 |
| JP | 07-057935 | 3/1995 | H01F/17/00 |
| JP | 07-106136 | 4/1995 | H01F/17/02 |
| JP | 07-176929 | 7/1995 | H01Q/1/40 |
| JP | 07-202538 | 8/1995 | H01Q/1/24 |
| JP | 08-316725 | 11/1996 | H01Q/11/08 |
| JP | 09-035842 | 2/1997 | H01R/43/00 |
| JP | 09-036643 | 2/1997 | H01Q/11/08 |
| JP | 10-065432 | 3/1998 | H01Q/1/38 |
| JP | 10-190512 | 7/1998 | H04B/1/38 |
| JP | 10-209736 | 8/1998 | H01Q/5/01 |
| JP | 10-294611 | 11/1998 | H01Q/3/44 |
| JP | 11-003411 | 1/1999 | G06K/19/07 |
| JP | 11-026047 | 1/1999 | H01R/9/05 |
| JP | 11-112219 | 4/1999 | H01Q/1/24 |
| KR | 00-018972 A | 4/2000 | |
| WO | WO 9718601 | 11/1996 | |
| WO | WO 97/18601 | 5/1997 | H01Q/1/36 |
| WO | WO 98/15028 | 4/1998 | H01Q/1/36 |
| WO | WO 9830799 | 7/1998 | |

* cited by examiner (a)

(b)

(a)

(b)

f1 : 971MHz (75MHz)
f2 : 1,768MHz (249MHz)

(a)

(b)

(a)

(b)

(a)

(b)

(a)

(b)

HELICAL ANTENNA MANUFACTURING APPARATUS AND METHOD THEREOF

BACKGROUND OF THE INVENTION (a) Field of the Invention

The present invention relates to a helical antenna manufacturing apparatus and method. More specifically, the present invention relates to a helical antenna, and an apparatus and method for automatically manufacturing the helical antenna.

(b) Description of the Related Art

Helical antennas are widely used in mobile stations. A helical antenna is an antenna in which copper lines are helically wound on a core made of an insulative material, thereby enabling the size of the antenna to be reduced. The performance of the helical antenna greatly affects the performance of the mobile station.

Referring to drawings, the prior helical antennas will now be described.

FIGS. 1(*a*) and (*b*) show schematic views of prior helical antennas used in conventional mobile stations.

As shown in FIG. 1(*a*), the conventional helical antenna is formed such that copper lines 2 are helically wound on a plastic core 1, that is, an insulative core. A conductive feeder 3, which is electrically connected to an external circuit, is formed on the lower part of the plastic core 1. An outer surface of the plastic core 1 is sealed with plastic resin 4.

This conventional antenna is manufactured using the following method. Referring to FIG. 1(*a*), grooves are helically formed on the outer surface of the cylindrical plastic core 1, and the copper lines 2 of a length of $\lambda/4$ are wound on the core 1 to form a helical line. Next, the conductive feeder 3, which is a fixed metallic body, is attached to the lower part of the plastic core 1, and the outer surface of the core 1 is molded with the plastic resin 4 by an injection molding process, thereby completing the manufacture of the helical antenna.

The characteristics of such a helical antenna depend on the helical lines, that is, the total length of the copper lines, pitch gaps between the copper lines, and a diameter of the core. Therefore, such dimensions must be carefully designed in order to enable the helical antenna to be operated in a desired frequency band.

However, in the case where the helical antenna is manufactured as described above (i.e., winding the copper lines on the plastic core), since the radio frequency (RF) characteristics of the plastic is low, the frequency characteristics of the antenna itself become lower. Also, the injection and molding processes required to manufacture the grooved plastic core have drawbacks in that they are accompanied by a high defective rate. These processes also make mass production difficult.

Hence, a helical antenna has been developed in which a core is not used. FIG. 1(*b*) shows a prior helical antenna in which no core is used.

As shown in FIG. 1(*b*), the helical antenna includes a spiral coil 5, a feeder 3 formed on the lower end of the coil 5, and plastic resin 4 formed as a seal surrounding the coil 5.

When manufacturing this helical antenna, an operator cuts the coil 5 to a predetermined length, attaches the feeder 3 to the lower end of the cut coil 5, and molds the outer surface of the coil 5 with the plastic resin 4 to complete the manufacture of the helical antenna.

There are at present various wireless communications services such as Code Division Multiple Access (CDMA), Personal Communication Service (PCS), Global System for Mobile communication (GSM), and Digital European Cordless Telephone (DECT), each using different frequency bands. Because of the different frequency bands used and the general incompatibility of these wireless communications services, it has become necessary to design multi-band antennas which enable use in various frequency bands. FIGS. 2(*a*) and (*b*) show schematic views of additional conventional helical antennas used in prior mobile stations.

As shown in FIG. 2(*a*), two copper lines 2 having differently designed resonance frequencies are formed on the plastic core 1, which is made of insulative material. As shown in FIG. 2(*b*), the helical antenna can also be manufactured with a spiral coil 5 and no use of a core. By making the number of spirals and the pitches of an upper coil 5*a* differently from those of a lower coil 5*b*, a helical antenna which operates in different resonance frequency bands can be manufactured.

As the frequencies used in mobile stations become higher, helical antennas with a high degree of precision are needed. However, in the case of manufacturing helical antennas by the conventional methods, since the operator manually cuts the coil to a predetermined length according to the operative frequency bands, productivity is limited and the precision is reduced. Further, in the case where a coil is used without a core, since the coil is deformed because of the elasticity of the coil itself, a surface molding process cannot be performed. Instead, a cover made of resin is placed on the coil to protect the coil. Consequently, the adhesive strength between the metallic feeder and the coil can be weakened such that the smooth operation of the antenna is at times unable to be realized. Also, in the conventional antenna where a core is used, because the resin is injected at a high pressure during the molding process, collision with the coil results so that the coil is deformed. This may act to change the resonance frequencies of the antenna, thereby decreasing productivity.

Further, since the resonance frequencies can be changed by different tensions in the coil, the operator must manually tune all the antennas. For this and other reasons, it is difficult to automate the conventional helical antenna manufacturing process. This results in a low rate of productivity, ultimately increasing manufacturing costs. In addition to these problems, since this conventional helical antenna is installed on an upper part of the communication device and protruded therefrom, that is, because of the external mounting of the antenna, the helical antenna can be damaged by receiving shock when the device is dropped, etc. Also, such a configuration makes the communication device difficult to handle. To overcome these problems, helical antennas which can be built within the communication device are being developed, and one such helical antenna is the micro-strip patch antenna. However, since the radiator of the conventional built-in antennas must be $\lambda/2$ in size, the whole size of the antenna becomes very big. To increase the usable bandwidth of the microstrip antenna, the width of the radiator and the thickness of a substrate must be increased, and therefore, the whole volume and weight of the antenna is increased. Hence, such built-in antennas are not suitable for use as helical antennas for mobile stations.

Since radiation occurs only in the direction of the upper part of the substrate on which the radiator is formed and not toward the lower part of the substrate on which ground patterns are formed in the conventional built-in antenna, the antenna develops directional properties. As a result, the sensitivity of the antenna is varied according to the direction the antenna is pointed.

It is important to note here that it is not feasible to install the helical antenna of FIGS. 1 and 2 within the mobile station since this would make it difficult to make the mobile station small in size. That is, since the antenna is formed by winding the copper lines on the plastic core or by using a spring-type coil, the copper lines or the coil can be deformed when the mobile station receives external shock. Accordingly, the antenna must be molded or sealed with a cover in order to prevent such deformation, which increases the entire size of the mobile station. Also, an additional metallic fixture is needed for connection with a print circuit board (PCB) of the mobile station, again acting to increase the size of the mobile station. Further, because of the difficulties in providing the antenna in a surface-mounted configuration, it is nearly impossible to install the antenna within the communication device.

Since a planar inverted F antenna (PIFA) is also big in size, the PIFA cannot be applied to a small device such as a wireless LAN card. The PIFA also has directional problems. In some cases, the antenna is manufactured as a chip and equipped within the device. However, such a chip-type antenna has low antenna characteristics, and therefore, can only be used in such devices as cordless phones.

SUMMARY OF THE INVENTION

It is an object of the present invention to provide an apparatus and method for automatically manufacturing helical antennas.

In one aspect of the present invention, a helical antenna manufacturing apparatus comprises a core made of insulative material; a first roller printing a conductive and viscous paste on a surface of the core to form a helical line; a roller driver rotating the first roller; a core driver rotating the core and moving the same in a longitudinal direction; and a controller controlling the roller driver and the core driver to control an rpm of the core, a longitudinal moving speed of the core, and the rpm of the roller, the longitudinal moving speed being set according to working frequency bands of the antenna.

The apparatus further comprises a paste box containing the paste; and a paste provider comprising a paste injector injecting the paste into the paste box.

The apparatus further comprises one or more second rollers contacted to the paste in the paste box and rotated, and providing the paste to the first roller.

An outer circumference of the first roller is sloped at a predetermined angle.

A diameter of a central part of the first roller is greater than a diameter of an outer part of the first roller.

The apparatus further comprises a core provider providing the core to a position to be contacted with the first roller; and a drier drying the core on which the helical line is formed.

In another aspect of the present invention, a helical antenna manufacturing apparatus comprises a core made of insulative material; a roller printing a conductive and viscous paste on a surface of the core to form a helical line unit comprising a first helical line of a first frequency band and a second helical line of a second frequency band; a roller driver rotating the roller; a core driver rotating the core and moving the same in a longitudinal direction of the core; and a controller controlling the roller driver and the core driver to control an rpm of the core and an rpm of the roller, and sequentially controlling the core driver according to a first moving speed which is set according to the first frequency band at which the antenna is operated and according to a second moving speed which is set according to the second frequency band.

In a further aspect of the present invention, a helical antenna manufacturing method comprises the steps of printing a conductive helical line on a surface of a core made of insulative material; dipping a part of the core in a conductive paste to form a terminal; connecting a feeder to the terminal of the core, the feeder being electrically connected to an external circuit; and sealing an outer part of the core with a cover of insulative material.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 13(*b*) shows the helical antenna of FIG. 12 in a state installed on a PCB substrate of a communication device;

FIG. 20(*b*) shows a circuit diagram of a signal processor of a mobile station using two helical antennas according to the sixth preferred embodiment of the present invention;

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
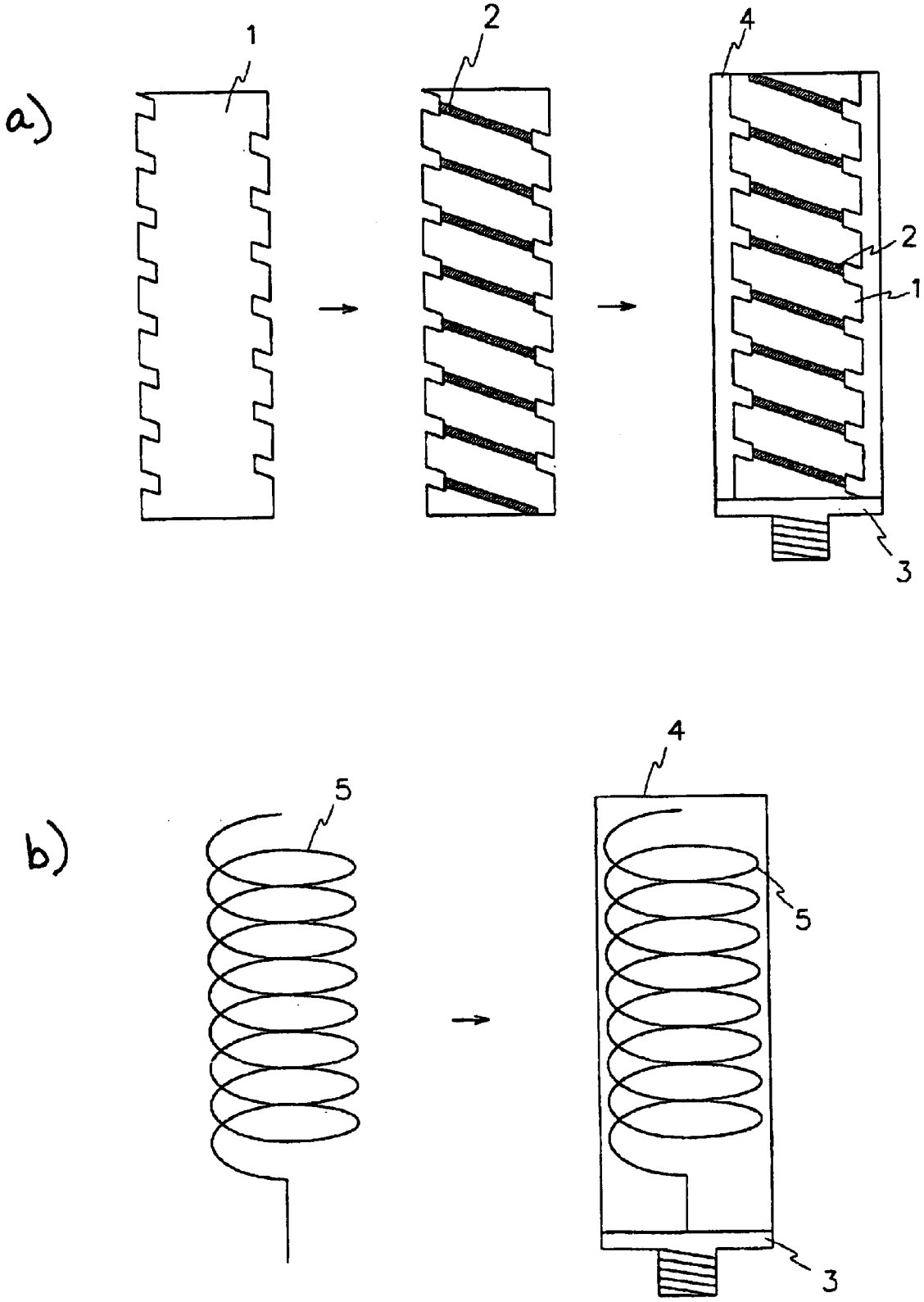
FIG. 1 PRIOR ART
FIGS. 1(*a*) and (*b*) show schematic views of conventional helical antenna used in prior mobile stations.
Figure 2:
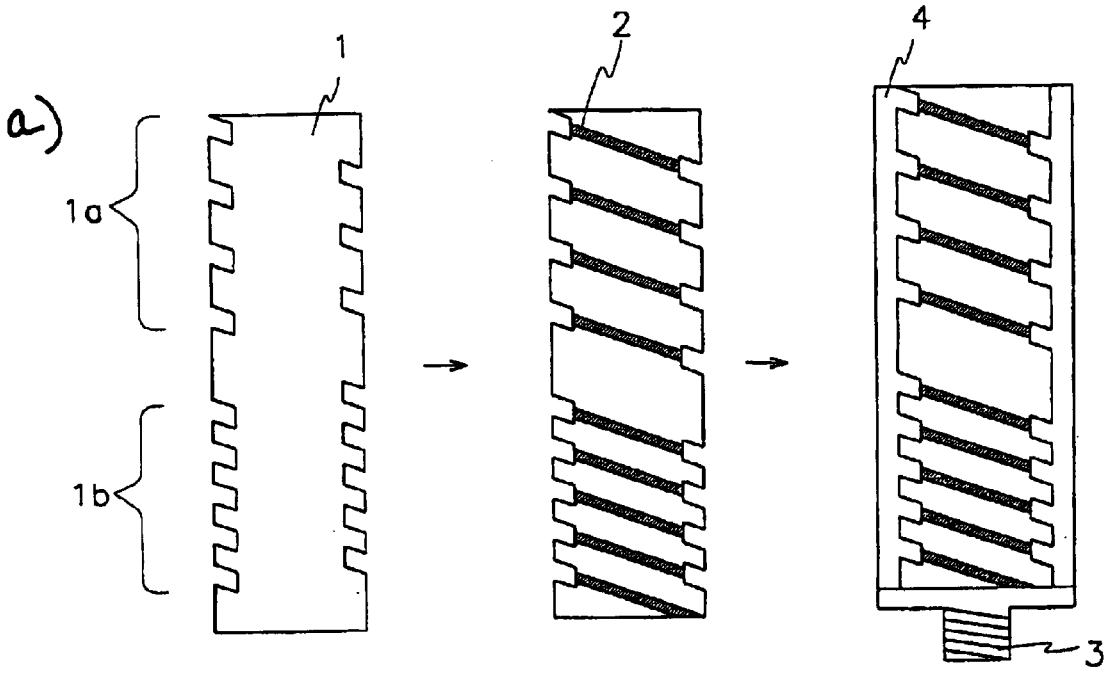
FIG.2 PRIOR ART
FIGS. 2(*a*) and (*b*) show schematic views of additional conventional helical antennas used in prior mobile stations.
Figure 2:
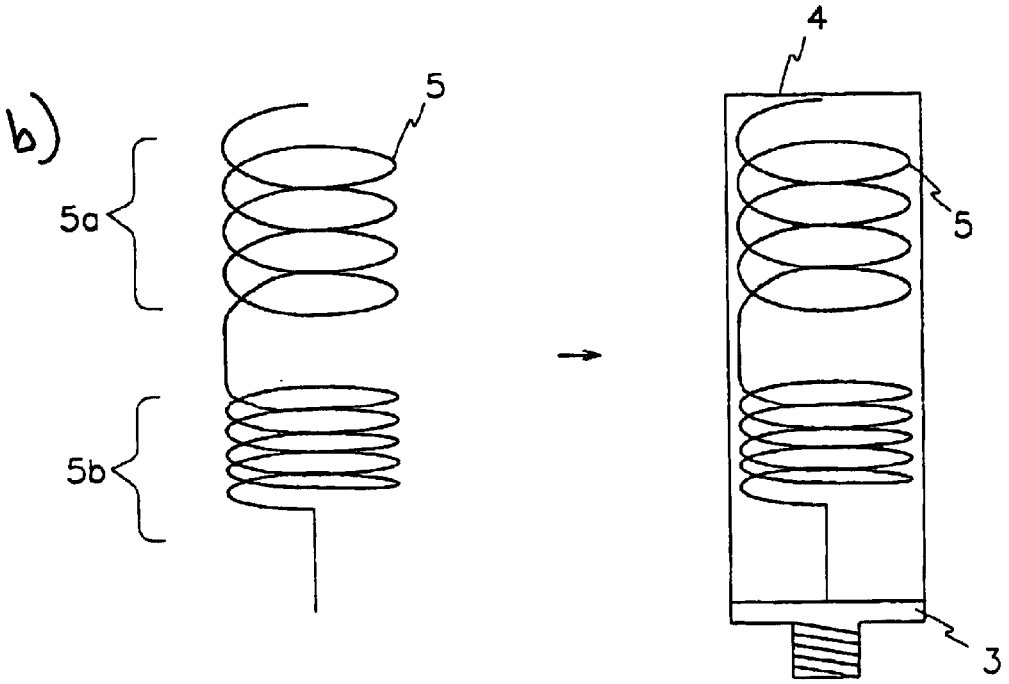
FIG.2 PRIOR ART
Figure 3:
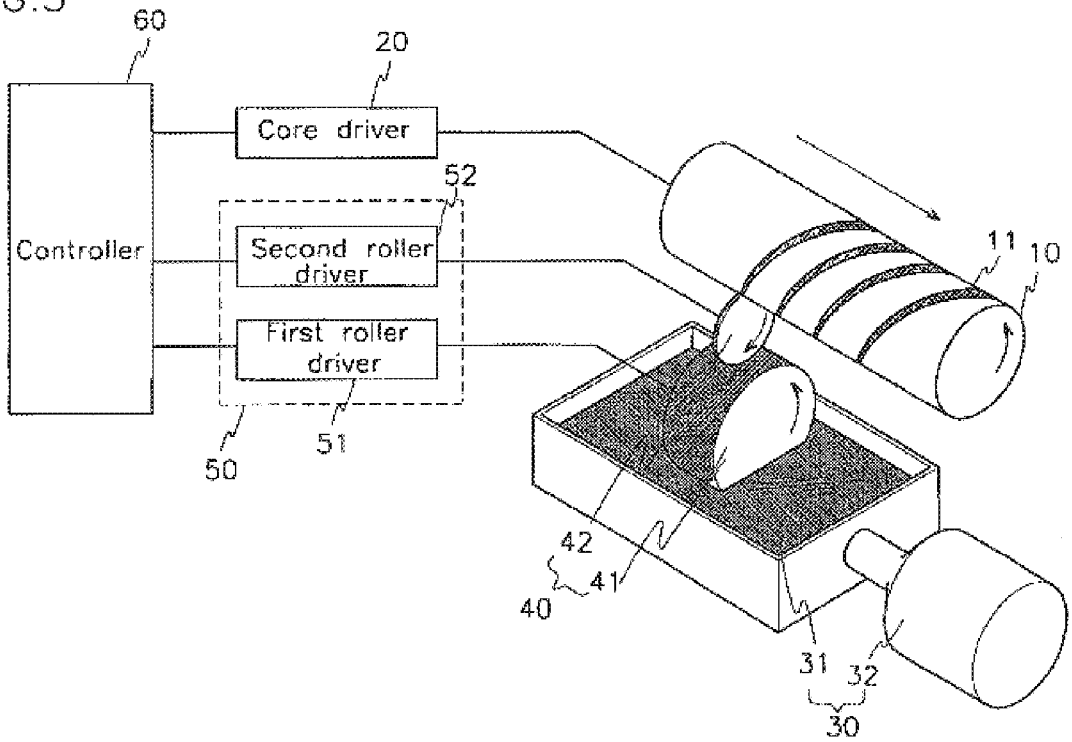
FIG. 3 shows a schematic view of a helical antenna manufacturing apparatus according to a first preferred embodiment of the present invention.
Figure 4:
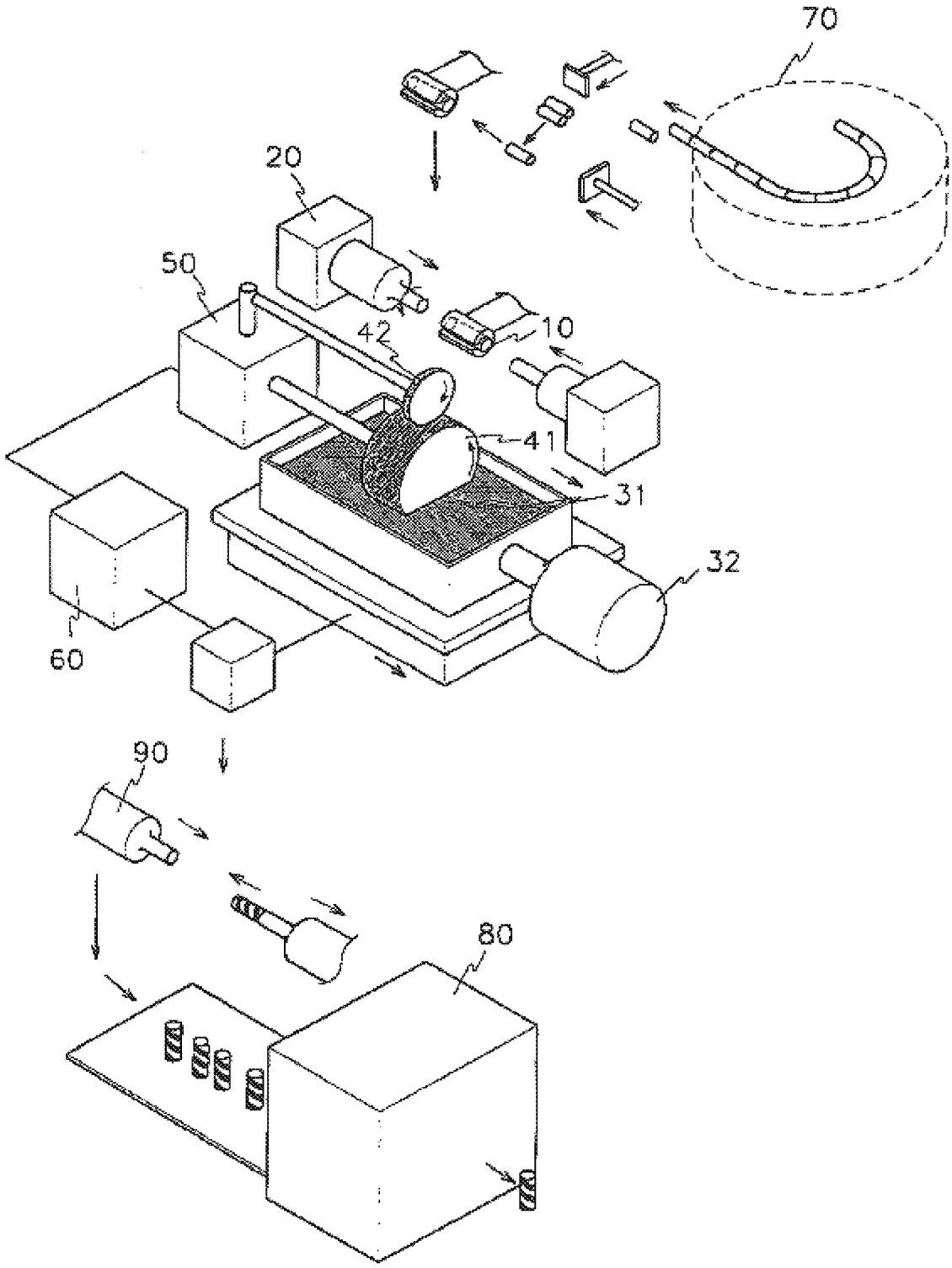
FIG. 4 shows a detailed view of the helical antenna manufacturing apparatus of FIG. 3.

FIG. 3 shows a schematic view of a helical antenna manufacturing apparatus according to a preferred embodiment of the present invention. FIG. 4 shows a detailed view of the helical antenna manufacturing apparatus of FIG. 3.

As shown in FIG. 3, the helical antenna manufacturing apparatus according to the first preferred embodiment of the present invention comprises a core 10; a core driver 20 rotating the core 10; a paste provider 30 providing conductive paste; a roller 40 printing the paste on a surface of the core 10; a roller driver 50 rotating the roller 40; and a controller 60 controlling the core driver 20 and the roller driver 50.

The core 10 is cylindrical and made of an insulative material such as plastic or ceramic. The core driver 20 rotates the core 10 according to control by the controller 60, and also moves the core 10 in a longitudinal direction.

The paste provider 30 comprises a paste box 31 which holds the paste; and a paste injector 32 injecting the paste into the paste box. The paste is made of material having conductivity and a predetermined level of viscosity. In the first preferred embodiment of the present invention, room temperature paste is used with the plastic core, and high temperature paste, which has an exceptionally high degree of electrical conductivity, is used with the ceramic core. Here, normal temperature and high temperature refer to the temperature at which the paste is dried.

The roller 40 is positioned partially within the paste box 31 and below the core 10, a lower sub-piece of the roller 40 contacting the paste and an upper sub-piece of the roller 40 contacting the core 10. Hence, when the roller 40 is rotated, the paste in the paste box 31 of the paste provider 30 is applied to the surface of the roller 40, then transferred to be printed on the surface of the rotating core 10.

As a result of this method, the amount of paste printed on the surface of the core 10 is varied according to the viscosity of the paste and the number of sub-pieces comprising the roller 40. That is, the greater the viscosity of the paste, the greater the amount of paste printed on the core 10, and the greater the number of sub-pieces of the roller 40, the less the amount of paste printed on the core 10.

In the first preferred embodiment of the present invention, two rollers, first and second rollers 41 and 42, are used so as to adjust the amount of the paste printed on the core 10 to a suitable level. The first roller 41 is positioned to be in contact with the paste in the paste box 31, and the second roller 42 is positioned above the first roller 41 so as to be in contact with the first roller 41 and the core 10. However, the number of the rollers is not restricted to this number, and it is also possible to use more rollers.

The roller driver 50 rotates the roller 40 according to control by the controller 60. In the first preferred embodiment of the present invention, the roller driver 50 comprises a first roller driver 51 driving the first roller 41, and a second roller driver 52 driving the second roller 42. The core driver 20, and the first and second roller drivers 51 and 52 according to the first preferred embodiment of the present invention are motors.

The controller 60 controls the operation of the core driver 20 and the roller driver 50 to control the paste patterns printed on the core 10. As the core 10 and the roller 40 rotate, and the core 10 is moved in the longitudinal direction, the printed patterns of the paste are formed as helical lines 11. The length and pitch of the helical lines formed on the surface of the core 10 are varied respectively by duration for which the core 10 and the roller 40 are rotated, and by the speed at which the core 10 is moved longitudinally.

The controller 60 establishes the rpm of the core 10 and the roller 40 according to diameters of the core 10 and the roller 40. The longitudinal moving speed of the core 10, and the rotational duration of the core 10 and the roller 40 are varied by the controller 60 according to the desired working frequency band of the antenna such that the paste is printed on the surface of the core 10 as the helical lines 11 of corresponding lengths and pitches.

As shown in FIG. 4, the helical antenna manufacturing apparatus according to the first preferred embodiment of the present invention further comprises a core provider 70 providing the core 10 in an unprocessed state to a print position, that is, a position to be contacted with the roller 40; a drier 80 drying the core 10 on which the paste is printed by heating the core 10 at a predetermined temperature; and a conveyor 90 conveying the printed core 10 to the drier 80.

An operation of the helical antenna manufacturing apparatus according to the first preferred embodiment of the present invention will now be described.

First, as shown in FIG. 4, the core 10 made of plastic or ceramic material is output from the core provider 70, and a grip holds the output core 10 to convey the same to a printing position. At this time, the conductive paste is supplied to the paste box 31 from the paste injector 32 of the paste provider 30.

When the core 10 is positioned on the printing position and the paste is supplied to the paste box 31, the controller 60 reads control values to drive the core 10 and the first and second roller 41 and 42 from an internal memory (not illustrated). In the preferred embodiment of the present invention, a plurality of control values to control the rpm of the core 10 and the roller 40 according to the diameters of the core 10 and the roller 40, and to control the longitudinal moving speed of the core 10 and the rotational duration of the core 10 and the roller 40 according to the working frequency bands of the antenna are set and stored in the controller 60.

The controller 60 drives the core driver 20 and the roller driver 50 according to the predetermined rpm set according to the diameters of the core 10 and the roller 40, and drives the core driver 20 according to the longitudinal moving speed of the core 10 set according to the working frequency bands of the antenna.

As the first and second roller drivers 51 and 52 and the core driver 20 are rotated by the controller 60, the first and second rollers 41 and 42 and the core 10 are respectively rotated, and the core 10 is rotated by the core driver 20 and simultaneously controlled to move in the longitudinal direction at a predetermined speed. At this time, the first and second rollers 41 and 42 are rotated in opposite directions, and the core 10 is rotated in the direction opposite the second roller 42.

Figure 5:
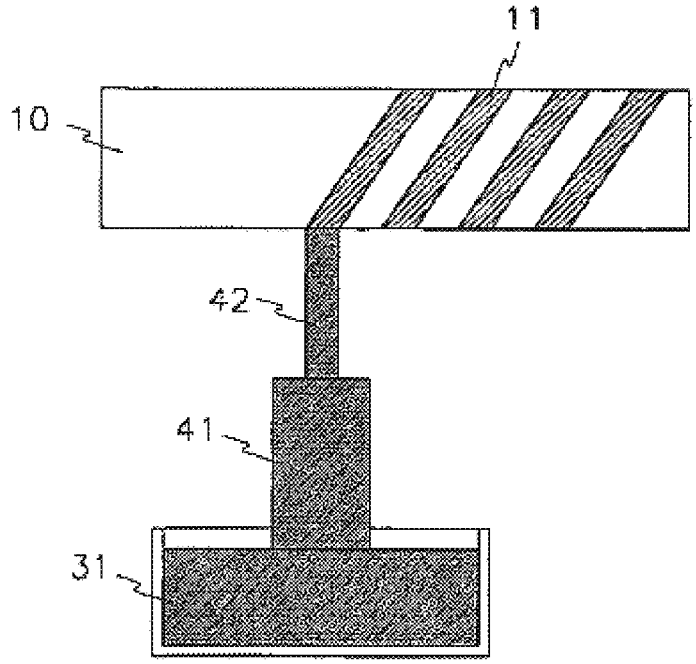
FIGS. 5(*a*) and (*b*) show side views of a core and a roller shown in FIG. 3 in a state of contact.
Figure 5:
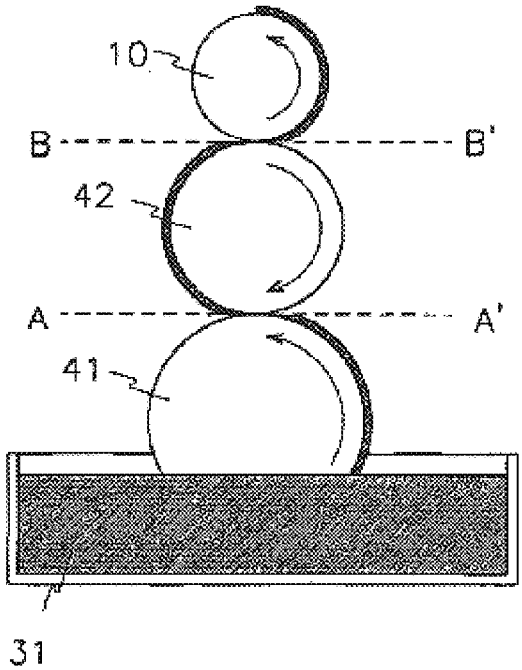

FIGS. 5(*a*) and (*b*) show side views of the core 10 and the roller 40 in a state of contact. As shown in FIG. 5(*b*), when the first roller 41 is rotated in the counterclockwise direction, the second roller 42 is rotated in the clockwise direction and the core 10 is rotated in the counterclockwise direction. The rpm of the first and second rollers 41 and 42 and the core 10 can be identical or different.

As the first roller 41 is rotated, the paste in the paste box 31 is applied to the surface of the first roller 41 and moves together with the rotation of the first roller 41. As shown in FIG. 5(*b*), when the paste comes to a point of A–A', the paste is applied to the second roller 42, which is in contact with the first roller 41 and rotated in the opposite direction. In this process, the amount of paste applied to the surface of the first roller 41 is reduced by a predetermined amount by the second roller 42. Hence, if an excessive amount of paste is applied to the surface of the first roller 41, this is adequately adjusted by the second roller 42.

As shown in FIG. 5(*b*), when the paste comes to a point of B–B' by moving together with the surface of the second roller 42, the paste applied to the second roller 42 starts to be printed on the surface of the rotating core 10. At this time, as the core 10 is rotated and moved also in the longitudinal direction as shown in FIG. 3, the helical lines 11 are formed on the surface of the core 10.

When the rpm of the core 10 is identical with the rpm of the second roller 42, the helical lines 11 are formed having a uniform width, and when the longitudinal moving speed of the core 10 is uniform, the helical lines 11 are formed having a uniform pitch. When the longitudinal moving speed of the core 10 is increased, the pitch of the helical lines 11 is increased, and when the longitudinal moving speed of the core 10 is reduced, the pitch of the helical lines 11 is reduced.

The controller 60 drives the core driver 20 and the roller driver 50 for a predetermined duration of time set according to the working frequency bands of the antenna, and when the rotational duration is expired, the controller 60 stops the rotation of the core 10 and roller 40. Therefore, the helical lines having a length corresponding to the working frequency bands of the antenna are formed on the surface of the core 10.

In the preferred embodiment of the present invention, as the rpm of the roller 40, and the rpm and longitudinal moving speed of the core 10 are controlled by the controller 60, a precision of the pitch of the helical antenna, which is the most important factor when manufacturing the helical antenna, can be improved. As a result, the defect rate can be greatly reduced even when manufacturing an antenna of high frequency bands. If high temperature paste is used to form the helical lines on the surface of the core 10, the conveyor 90 conveys the printed core 10 to the drier 80 of FIG. 4. The core 10 conveyed to the drier 80 is dried by a heating process at a temperature of about 600~800° C., and according to this drying process, the helical lines, that is, the high-temperature paste printed on the surface of the core 10, come to have electrical conductivity. In this case, ceramic material which is resistant to high temperatures is used for the material of the core 10, thereby preventing deformation of the core 10. On the other hand, if room temperature paste is used to form the helical lines on the surface of the core 10, since the paste dries at room temperature, the drying process does not need to be performed. In this case, plastic is generally used as the material of the core 10.

Figure 6:
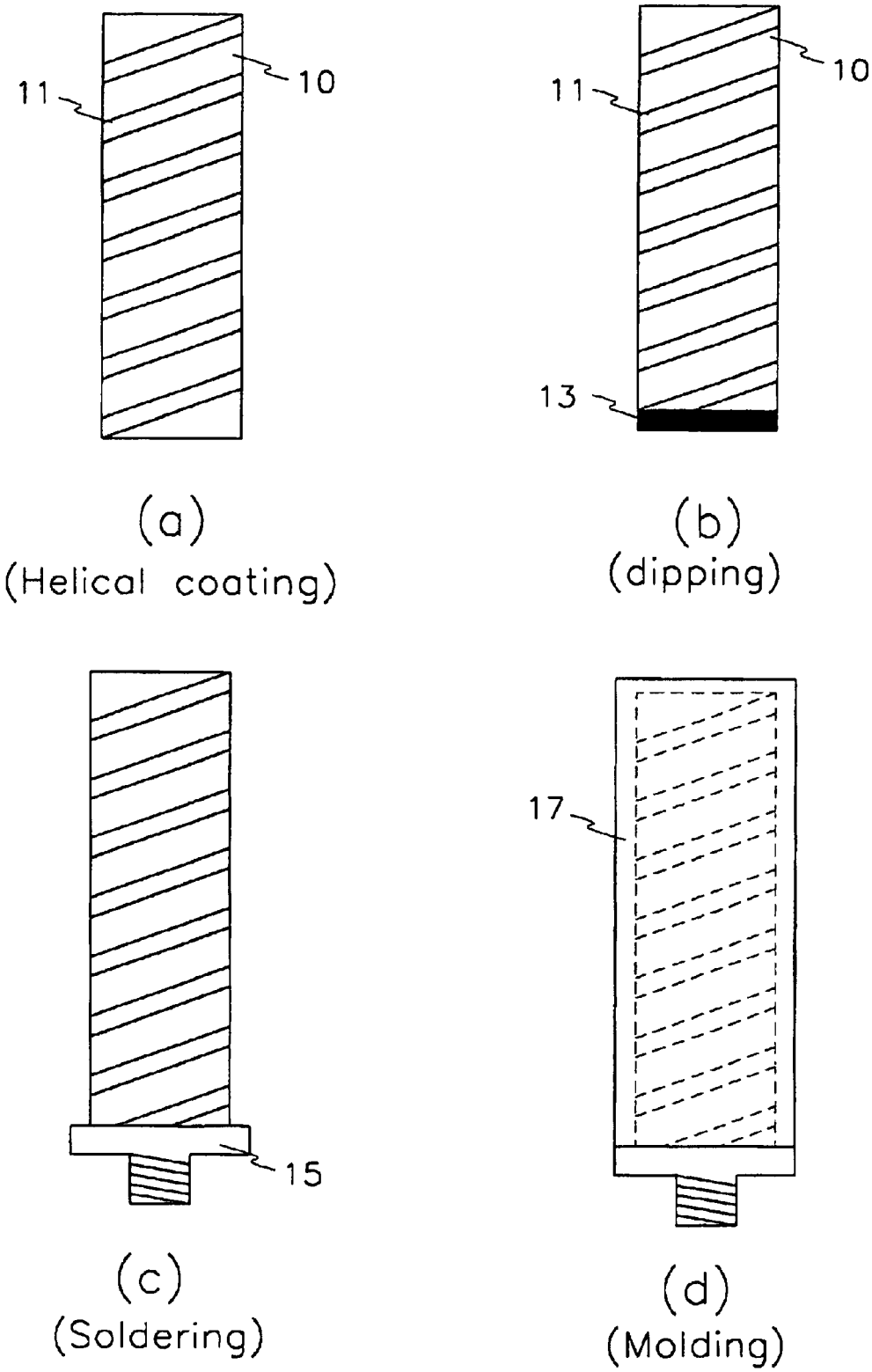
FIGS. 6(*a*)–6(*d*) show side views of a helical antenna after having undergone sequential manufacturing processes according to the first preferred embodiment of the present invention.

Next, the helical antenna is completed according to steps shown in FIG. 6. FIG. 6 shows side views of the helical antenna after having undergone sequential manufacturing processes according to the first preferred embodiment of the present invention. The paste is printed on the surface of the core 10 to form the helical lines as shown in FIG. 6(*a*) and as described above. Subsequently, a lower part of the core 10 is dipped into metallic paste to form a terminal 13 as shown in FIG. 6(*b*), after which a metallic fixture is soldered on the terminal 13 of the core 10 to form a feeder 15 as shown in FIG. 6(*c*). The metallic fixture enables connection of the helical antenna to a system such as a mobile station. Next, plastic resin, that is, insulation, is externally molded on the core 10 to form a cover 17, thereby completing the helical antenna.

By these processes, a highly precise helical antenna is manufactured in which the conductive helical lines are printed on the surface of the core 10, and a feeder 15, which is connected electrically to an external circuit, is formed on the lower part of the core 10. Next, a helical antenna manufacturing apparatus and method according to a second preferred embodiment of the present invention will be described.

Figure 7:
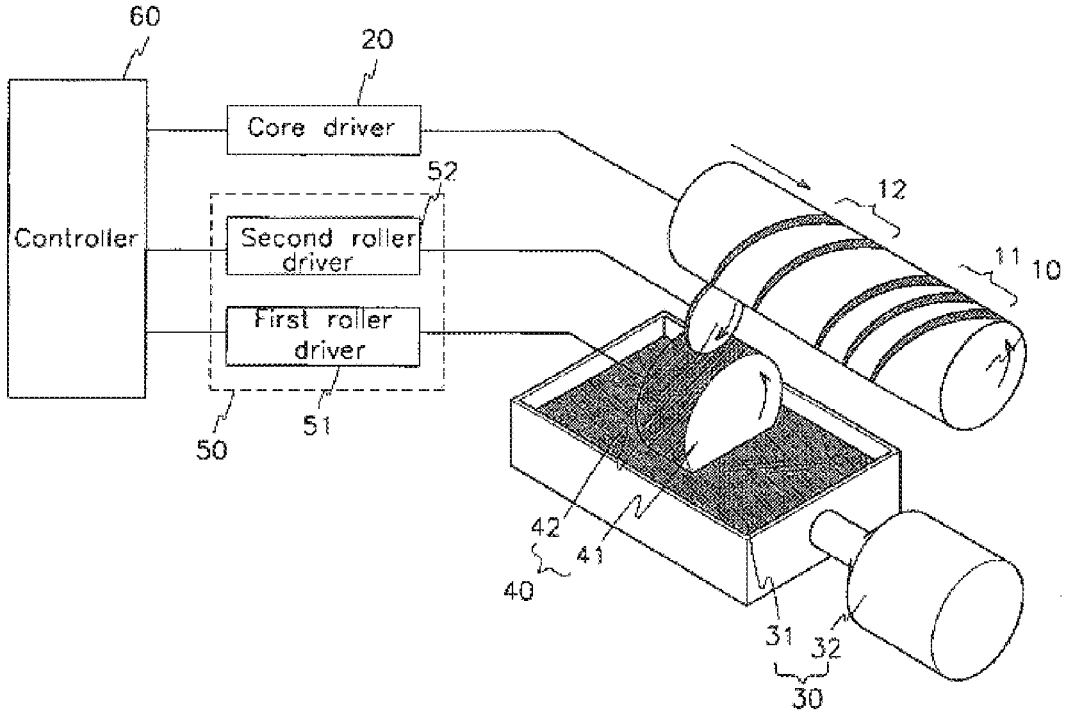
FIG. 7 shows a schematic view of a helical antenna manufacturing apparatus according to a second preferred embodiment of the present invention.

FIG. 7 shows a schematic view of a helical antenna manufacturing apparatus according to the second preferred embodiment of the present invention. The same reference numerals will be used for elements identical to those appearing in the first embodiment. Differing from the first preferred embodiment of the present invention, the controller 60 controls the operation of the core driver 20 and the roller driver 50 to control the printing patterns of the paste printed on the core 10 such that the printed patterns of the paste are formed as first and second helical lines 11 and 12. That is, the controller 60 changes the longitudinal moving speed of the core 10 for the first and second helical lines 11 and 12 so that the pitches of the first and second helical lines 11 and 12 formed on the surface of the core 10 are changed.

The controller 60 controls the rotation of the core 10 and the roller 40 according to the rpm which is set according to the diameters of the core 10 and roller 40, controls the movement of the core 10 in the longitudinal direction according to the longitudinal moving speed which is set according to the working frequency bands of the antenna so that the paste may be printed as helical lines having predetermined lengths and pitches, and changes the longitudinal moving speed of the core 10 in two or more steps according to the frequency bands so that the paste is printed as the first and second helical lines 11 and 12 having different pitches on the surface of the core 10.

An operation of the helical antenna manufacturing apparatus according to the second preferred embodiment of the present invention will now be described.

Figure 8:
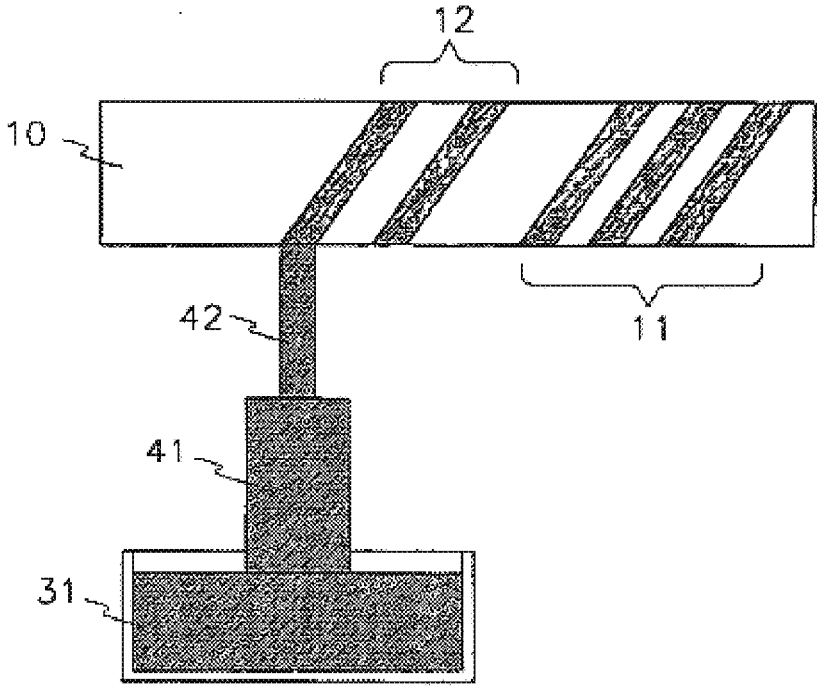
FIGS. 8(*a*) and (*b*) show side views of a core and a roller shown in FIG. 7 in a state of contact.
Figure 8:
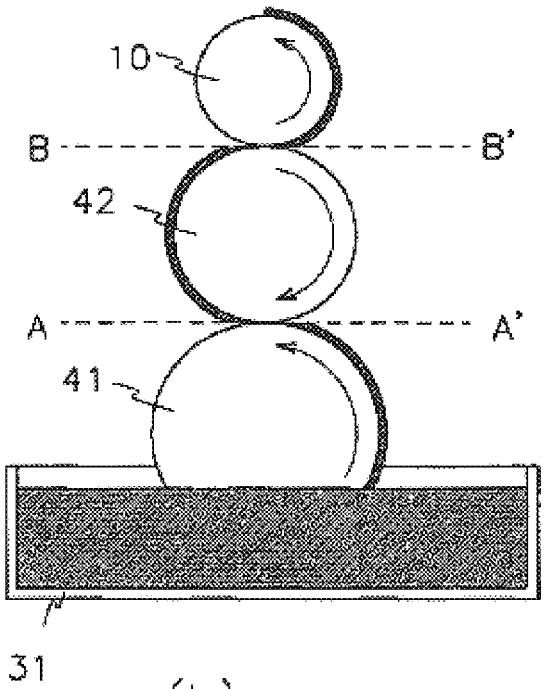

FIGS. 8(*a*) and 8(*b*) show side views of the core 10 and the roller 40 in a state of contact. When the core 10 positioned in the printing position, and the paste is supplied to the paste box 31, the controller 60 reads the control values to drive the core 10 and the first and second rollers 41 and 42 from the memory (not illustrated).

In the preferred embodiment of the present invention, a plurality of control values to control the rpm of the core 10 and the roller 40 according to the diameters of the core 10 and the roller 40, and to control the longitudinal moving speed of the core 10 and the rotational duration of the core 10 and the roller 40 according to the working frequency bands of the antenna, the number of bands being set and stored in the controller 60. For example, in the case there are two frequency bands for the antenna, the control values are set for the longitudinal moving speed to be changed two times, and for the moving speeds of each step to be changed according to the working frequency bands. The rotational duration for each step can also be differently set according to the working frequency bands of the antenna.

The controller 60 drives the core driver 20 and the first and second roller drivers 51 and 52 according to the predetermined rpm, and drives the core driver 20 according to the longitudinal moving speeds which are differently set for each step according to the working frequency bands of the antenna and the number of bands. For example, when manufacturing a dual-band helical antenna which is operable in two different frequency bands, the controller 60 drives the core driver 20 according to a first moving speed corresponding to a first frequency band for a first rotational duration, and when the first rotational duration is expired, the controller 60 sequentially drives the core driver 20 according to a second moving speed corresponding to a second frequency band for a second rotational duration so that the core 10 is moved at the different first and second moving speeds in the respective steps.

As the first and second roller drivers 51 and 52 and the core driver 20 are rotated by the controller 60, the first and second rollers 41 and 42 and the core 10 are respectively rotated, and the core 10 is rotated by the core driver 20 and simultaneously controlled to move in the longitudinal direction. At this time, the first and second rollers 41 and 42 are rotated in the opposite directions, and the core 10 is rotated in the direction opposite the second roller 42.

For example, as shown in FIG. 8(*b*), when the first roller 41 is rotated in the counterclockwise direction, the second roller 42 is rotated in the clockwise direction and the core 10 is rotated in the counterclockwise direction, opposite the second roller 42. The rpm of the first and second rollers 41 and 42 and the core 10 can be identical or different.

As the first roller 41 is rotated, the paste in the paste box 31 is applied to the surface of the first roller 41 and moves together with the rotation of the first roller 41. As shown in FIG. 8(*b*), when the paste comes to a point of A–A', the paste is applied to the second roller 42, which is in contact with the first roller 41 and rotated in the opposite direction. In this process, the amount of paste applied to the surface of the first roller 41 is reduced by a predetermined amount by the second roller 42. Hence, if an excessive amount of paste is applied to the surface of the first roller 41, this is adequately adjusted by the second roller 42.

As shown in FIG. 8(*b*), when the paste comes to a point of B–B' by moving together with the surface of the second roller 42, the paste applied to the second roller 42 starts to be printed on the surface of the rotating core 10. At this time, as the core 10 is rotated and moved also in the longitudinal direction as shown in FIG. 7, the helical lines 11 are formed on the surface of the core 10.

At this time, the core 10 is moved at a first moving speed for a first rotational duration by control of the controller 60, and when the first rotational duration is expired, the core 10 is moved at a second moving speed for a second rotational duration. Hence, the first and second helical lines 11 and 12 having different pitches are sequentially formed on the surface of the core 10. In the case the first and second rotational durations are identical, the lengths of the first and second helical lines 11 and 12 formed on the surface of the core 10 are identical, and in the case the first and second rotational durations are not identical, the lengths of the first and second helical lines 11 and 12 formed on the surface of the core 10 are different.

Figure 9:
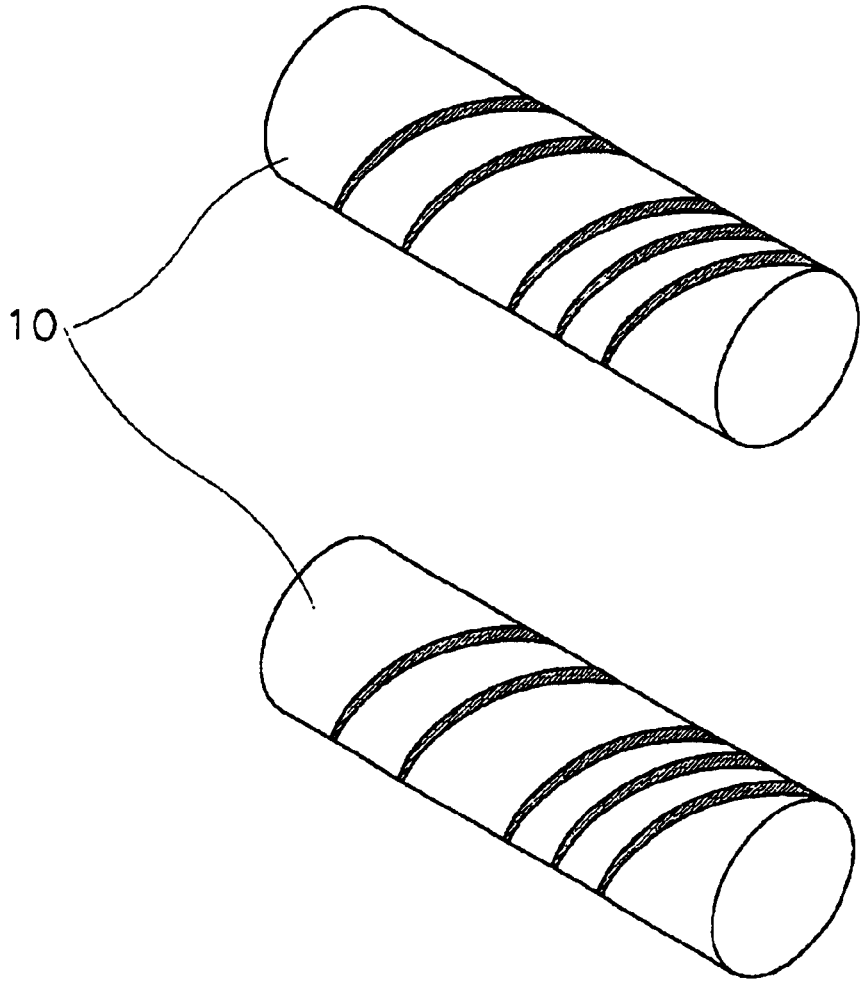
FIG. 9 shows the helical lines printed on the core according to the second preferred embodiment of the present invention.

When the rpm of the core 10 is identical with the rpm of the second roller 42, the helical lines are formed having a uniform width, and when the longitudinal moving speed of the core 10 is uniform, the helical lines 11 are formed having a uniform pitch. At this time, when the longitudinal moving speed of the core 10 is increased, the pitch of the helical lines is increased, and when the longitudinal moving speed of the core 10 is reduced, the pitch of the helical lines is reduced. FIG. 9 shows the core on which the two helical lines are formed having different pitches and lengths.

Therefore, two helical lines having different pitches can be formed by differing the first and second moving speeds of the core 10, and two helical lines having different lengths can be formed by differing the first and second rotational durations.

In the case there are more than two working frequency bands of the antenna, the longitudinal moving speeds of the core 10 are differently set for each working frequency band, and the core 10 therefore is moved at the different moving speeds so that a corresponding number of helical lines having different pitches can be formed. Through such manufacture, the helical antenna is operable at a plurality of frequency bands. In the second preferred embodiment of the present invention, as the rpm of the roller 40, and the rpm and longitudinal moving speed of the core 10 are controlled by the controller 60, a precision of the pitch of the helical antenna, which is the most important factor when manufacturing the helical antenna, can be improved. As a result, the defect rate can be greatly reduced even when manufacturing an antenna of high frequency bands.

If high temperature paste is used to form the helical lines on the surface of the core 10, as described in the first preferred embodiment of the present invention, the core 10 is dried in the drier 80 by a heating process at a temperature of about 600~800° C. As a result of this process, the helical lines come to have electrical conductivity.

On the other hand, if room temperature paste is used to form the helical lines on the surface of the core 10, since the paste dries at room temperature, the drying process does not need to be performed. In this case, plastic is generally used as the material of the core 10.

Figure 10:
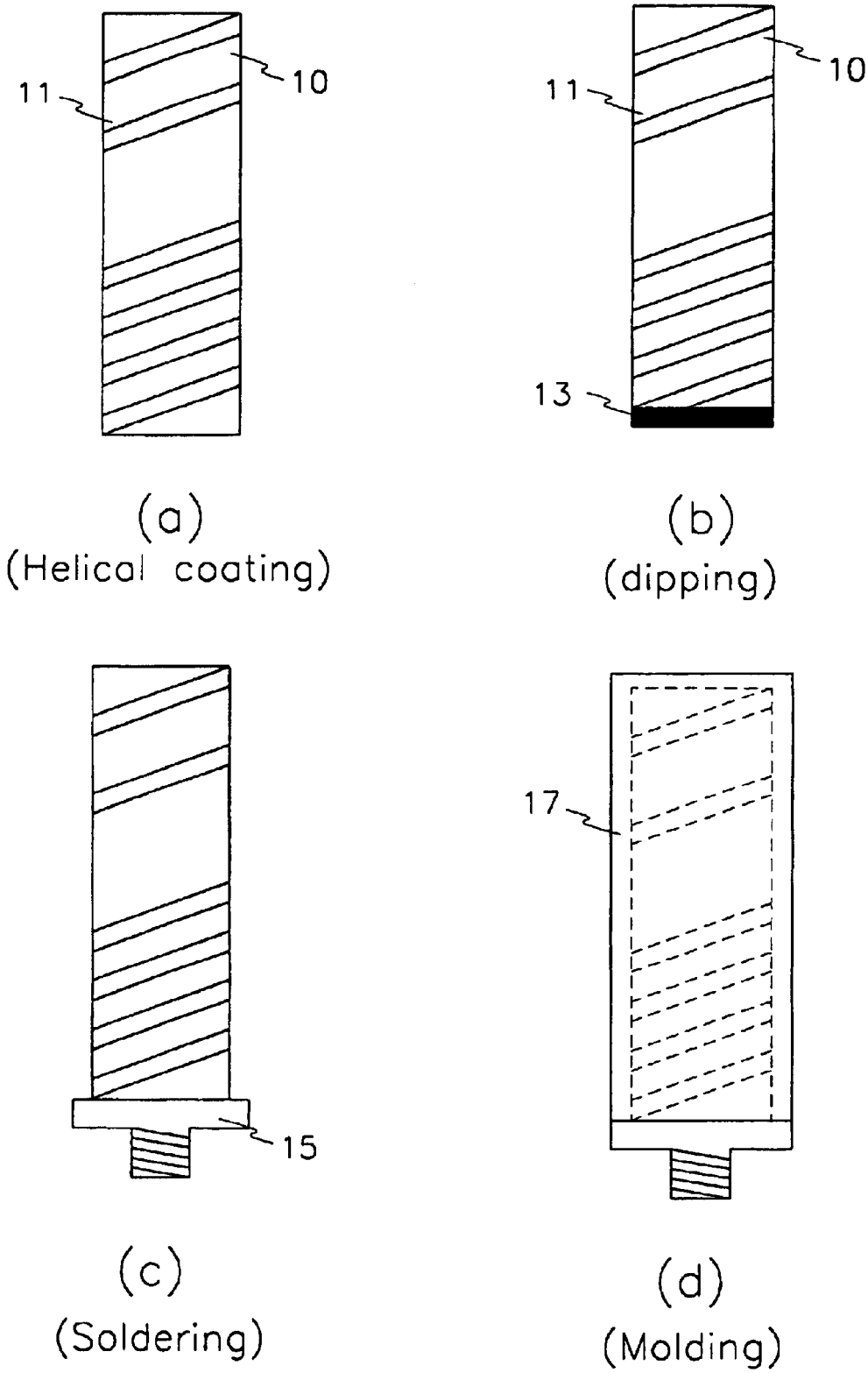
FIGS. 10(*a*)–10(*d*) show side views of a helical antenna after having undergone sequential manufacturing processes according to the second preferred embodiment of the present invention.

Next, the helical antenna is completed according to steps shown in FIG. 10. FIG. 10 shows side views of the helical antenna after having undergone sequential manufacturing processes according to the second preferred embodiment of the present invention.

The paste is printed on the surface of the core 10 to form the first and second helical lines 11 and 12 as shown in FIG. 10(*a*). Next, a lower part of the core 10 is dipped into a metallic paste to form a terminal 13 as shown in FIG. 10(*b*), after which a metallic fixture is soldered on the terminal 13 of the core 10 to form a feeder 15 as shown in FIG. 10(*c*). The metallic fixture enables connection of the helical antenna to a system such as a mobile station. Next, plastic resin, that is, insulation, is externally molded on the core 10 to form a cover 17, thereby completing the helical antenna.

Figure 11:
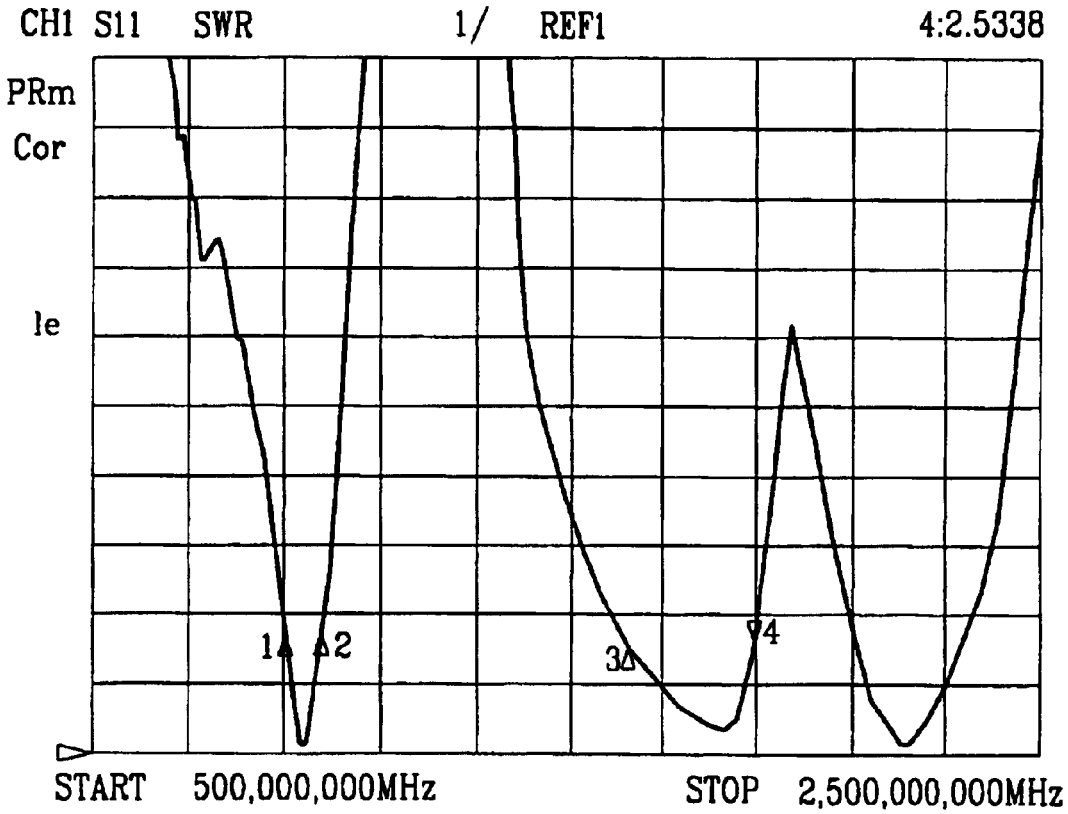
FIG. 11 shows frequency characteristics of the helical antenna according to the second preferred embodiment of the present invention.

By these processes, a highly precise helical antennas is manufactured in which the conductive helical lines are printed on the surface of the core 10, and a feeder 15, which is connected electrically to an external circuit, is formed on the lower part of the core 10. FIG. 11 shows the frequency characteristics of the helical antenna according to the second preferred embodiment of the present invention.

Next, a helical antenna manufacturing method according to a third preferred embodiment of the present invention will be described.

Figure 12:
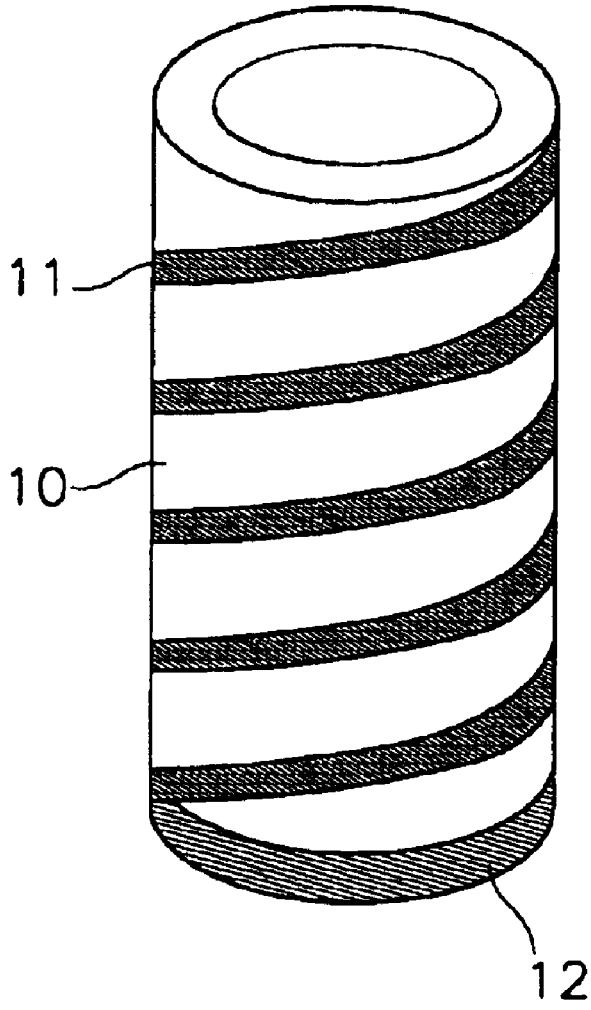
FIG. 12 shows a helical antenna according to a third preferred embodiment of the present invention.

FIG. 12 shows a helical antenna according to a third preferred embodiment of the present invention.

As shown in FIG. 12, the helical antenna comprises a core 10 which is made of insulative material and has a cavity formed along a center portion of the core 10; a helical line 11 which is printed on an outer surface of the core 10 and has conductivity; and a feeder 12 which is formed connected to the helical line 11 on the lower end of the core 10, and is electrically connected to an external circuit. The helical line 11 and the feeder 12 are made of conductive paste, and the cylindrical core 10 is made of insulative material such as plastic or ceramic. A helical antenna manufacturing apparatus for producing the helical antenna of the third preferred embodiment is identical with the first preferred embodiment of the present invention.

Next, a helical antenna manufacturing method according to the third preferred embodiment of the present invention will be described.

First, the helical line 11 is formed on the surface of the core 10. Since the method for forming the helical line 11 on the surface of the core 10 is identical with the methods according to the first and second preferred embodiments of the present invention, a detailed description will not be provided.

The helical line 11 is formed by printing the paste on the surface of the core 10, and the feeder 12 is then formed by dipping the lower end of the core 10 in metallic paste, thereby completing the helical antenna. The core 10 is installed on an internal PCB of a communication device by a soldering process.

Figure 13:
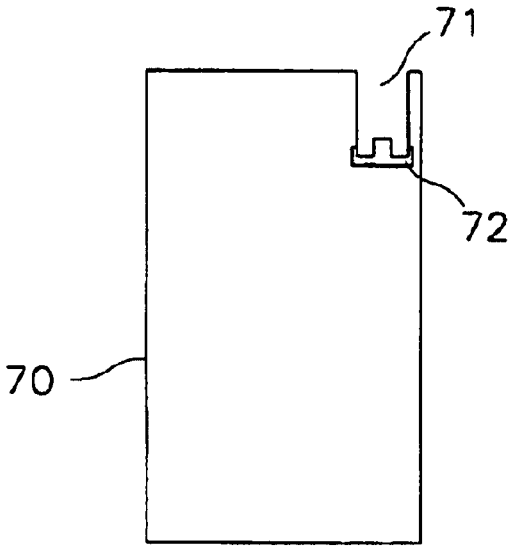
FIG. 13(*a*) shows a PCB substrate on which the helical antenna of FIG. 12 is installed.
Figure 13:
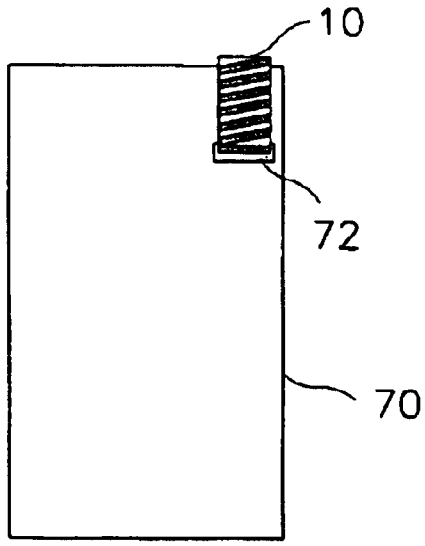

FIG. 13(*a*) shows a PCB substrate on which the helical antenna according to the third preferred embodiment of the present invention is installed. FIG. 13(*b*) shows the helical antenna according to the third preferred embodiment of the present invention in a state installed on a PCB substrate of a communication device.

As shown in FIG. 13(*a*), an installation unit 71 to install the helical antenna is formed by cutting and processing an upper part of a PCB substrate 70. On the other hand, since the core 10 of the helical antenna according to the third preferred embodiment of the present invention has an internal cavity, the installation unit 71 is formed having a convex portion, and the size of this convex portion is identical to an inner diameter of the core 10, thereby enabling the core 10 to be physically inserted in the convex portion for attachment to the PCB substrate 70.

A land 72 is formed so that the helical antenna according to the third preferred embodiment of the present invention can be firmly attached to the PCB substrate 70 and so that the helical antenna can be attached to the lower part of the installation unit 71 by a soldering process or by using glue.

After the installation unit 71 to install the helical antenna on the PCB substrate 70 is formed, the core 10, on which the helical line 11 and the feeder 12 is inserted on the convex portion of the installation unit 71, is fixed by the soldering process or by using glue. Therefore, the feeder 12 of the core 10 is attached to the land 72 which is installed on the installation unit 71 of the PCB substrate 70 so that the helical antenna according to the preferred embodiment of the present invention is installed on the PCB substrate 70 of the communication device.

At this time, in the case heat-resistant ceramic material is used for the core 10, the core 10 is connected to the PCB substrate 70 by a reflow soldering method using lead, and in the case the core 10 is plastic, which has a low resistance to heat, the core 10 is connected to the PCB substrate 70 using conductive glue instead of by the soldering method.

The ground patterns on the installation unit 71 of the PCB substrate 70 on which the antenna is positioned are removed so that the antenna freely radiates.

Since the helical antenna can be manufactured smaller in size, and the antenna can be directly attached on the PCB substrate 70 without additional components when installing the antenna within the communication device as described above, the manufacturing process is made simple.

Further, since the antenna according to the preferred embodiment of the present invention can be easily built within the communication device as described above, the antenna can be installed on any location of the PCB substrate 70 as shown in FIG. 13(*b*).

Figure 14:
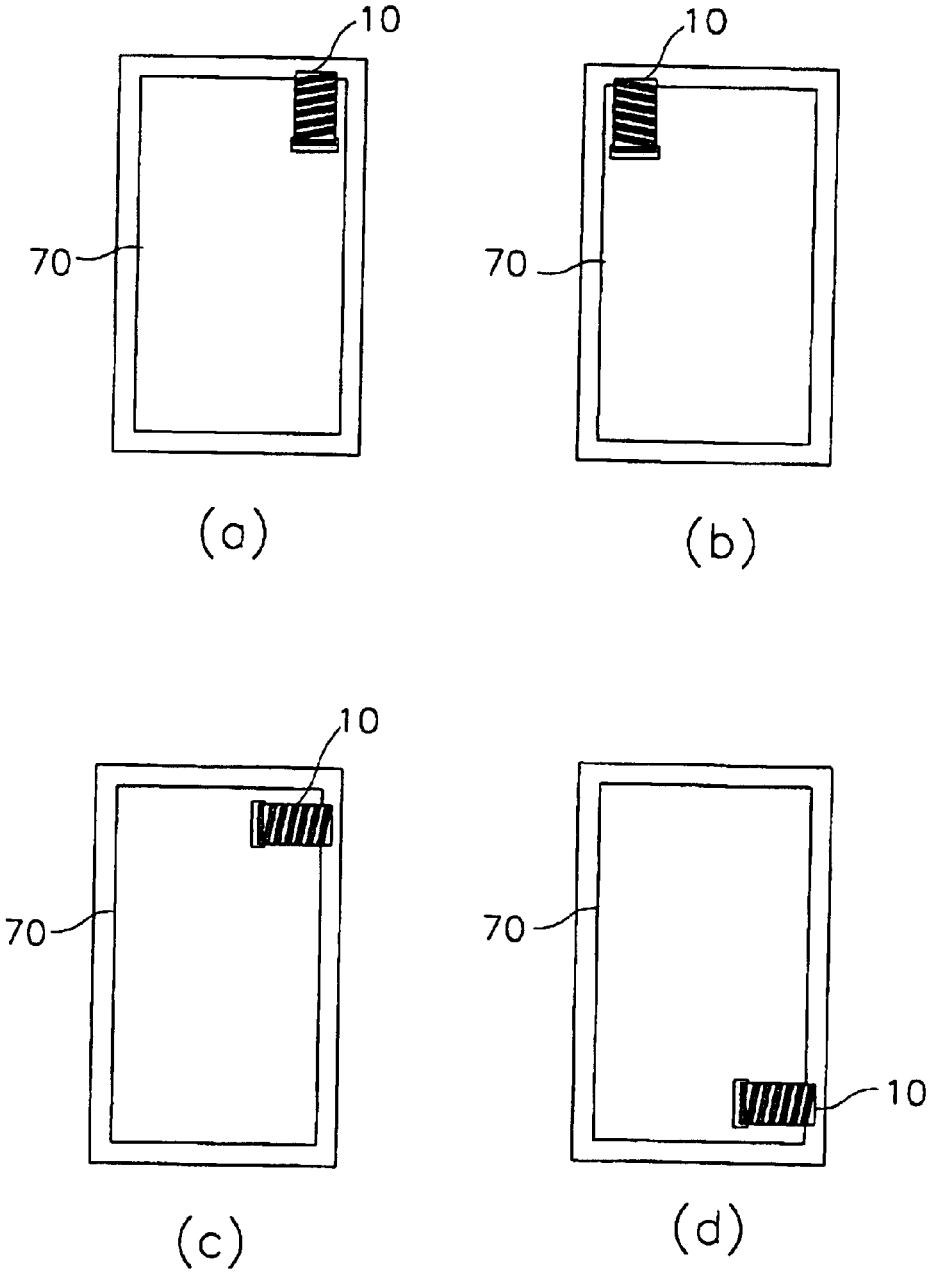
FIGS. 14(*a*)–14(*d*) and FIGS. 15(*a*)–5(*d*) show various examples in which the helical antenna is installed on different locations of the PCB substrate according to the third preferred embodiment of the present invention.
Figure 15:
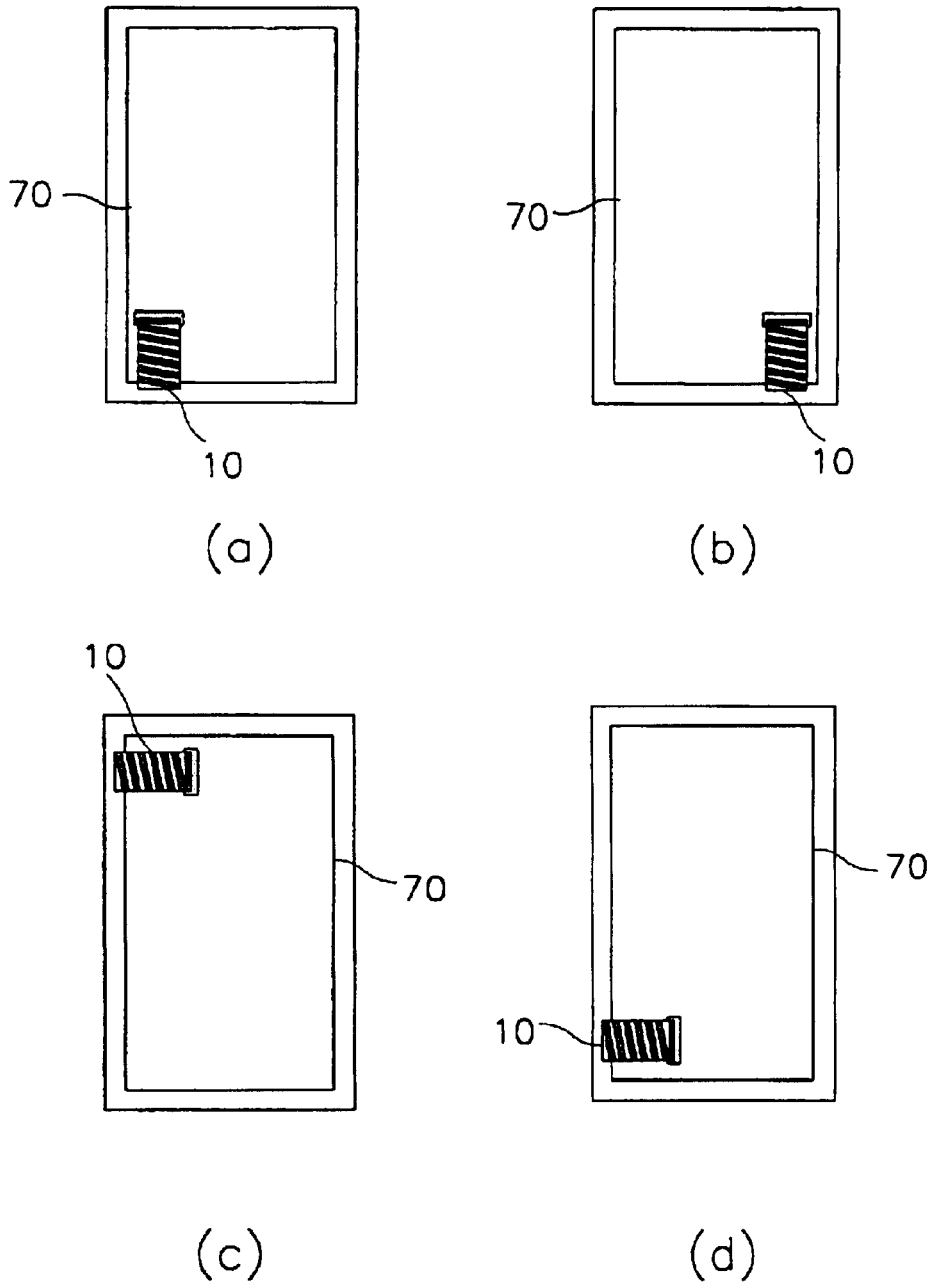

FIGS. 14 and 15 illustrate various examples in which the antenna according to the third preferred embodiment of the present invention is installed on different locations of the internal PCB substrate of the communication device.

As shown by the drawings, the antenna can be positioned at any position adjacent to a corner of the PCB substrate 70.

Since there is no limit to the position at which the antenna can be installed, it is possible to place the antenna on the lower part of the terminal, at a distance from the user's head when using the antenna of the preferred embodiment as the communication device. Accordingly, harmful effects caused by radio waves can be reduced.

The antenna manufactured in the above-mentioned manner can be easily equipped in a small wireless communication devices such as PCMCIA cards as well as the mobile stations.

A helical antenna manufacturing method according to a fourth preferred embodiment of the present invention will now be described.

Figure 16:
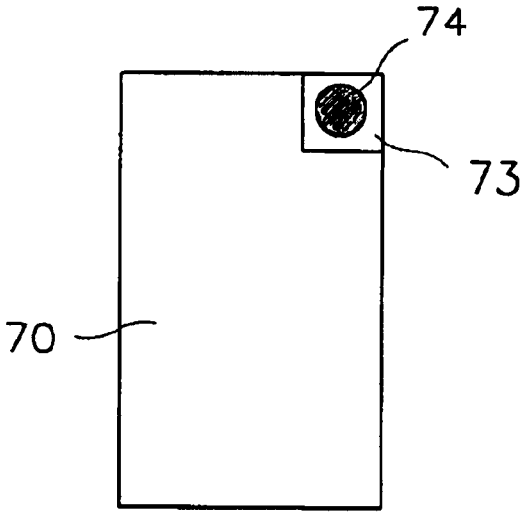
FIG. 16(*a*) and (*b*) are respectively a plane view and a side view of a PCB substrate on which a helical antenna is installed according to a fourth preferred embodiment of the present invention.
Figure 16:
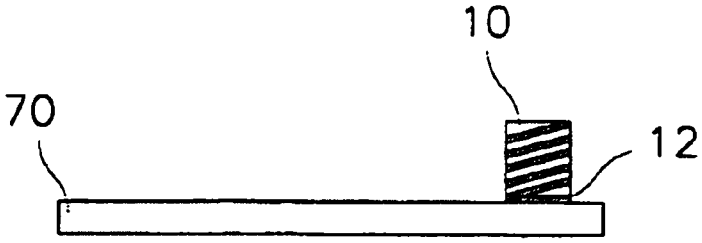

FIG. 16(*a*) shows a plane view of a PCB substrate on which a helical antenna is installed according to a fourth preferred embodiment of the present invention. FIG. 16(*b*) shows a side view of the PCB substrate of FIG. 16(*a*).

In the drawings, the helical antenna is identical to that of the third preferred embodiment of the present invention. However, the structure of the PCB substrate 70 on which the core 10 is installed is different from the third preferred embodiment of the present invention.

As shown in FIG. 16(*b*), in order to install the core 10 having printed thereon the helical line on a particular part of the PCB substrate 70, some of the ground patterns on the upper and lower surfaces of the PCB substrate 70 are removed to form the installation unit 73. At this time, the land 74 having a predetermined shape is formed without removing all the ground patterns to enable the core 10 to be installed on the center of the installation unit 73. Here, the land 74 can be a size corresponding to that of the inner diameter of the core 10.

Next, the core 10 on which the helical line is printed is placed on the land 74, and the core 10 is then attached to the land 74 by a soldering process or by using glue. Hence, the feeder 12 of the core 10 is adhered to the land 74 of the PCB substrate 70 so that the core 10 and the PCB substrate 70 are connected to be operated as a built-in antenna.

At this time, in the case the core is made of heat-resistant ceramic material, the core 10 is connected to the PCB substrate 70 by a reflow soldering method using lead, and in the case the core 10 is plastic, which has a low resistance to heat, the core 10 is connected to the PCB substrate 70 using conductive glue.

FIG. 16(*b*) shows a side view in which the core 10 is connected to the PCB substrate 70. As shown in the drawing, in the fourth preferred embodiment of the present invention, the helical antenna is installed perpendicular to the PCB substrate 70.

Figure 17:
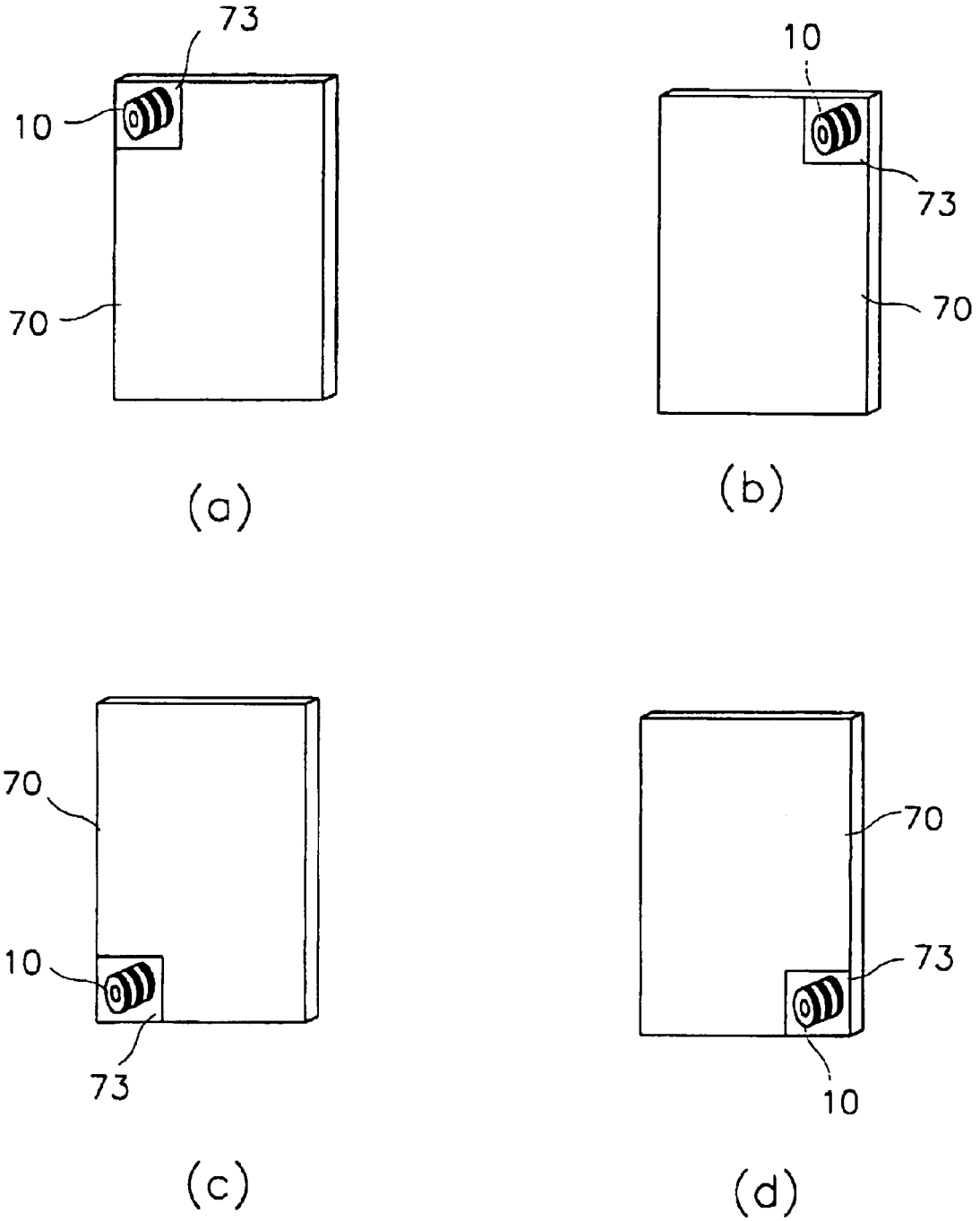
FIGS. 17(*a*)–17(*d*) show various examples in which the helical antenna is installed on different locations of the PCB substrate according to the fourth preferred embodiment of the present invention.

FIG. 17 shows various examples in which the helical antenna is installed on different locations of the PCB substrate according to the fourth preferred embodiment of the present invention. As shown, the helical antenna can be installed at various locations adjacent to the corners of the PCB substrate. In contrast to the above-noted third and fourth preferred embodiments of the present invention, the antenna can be electrically connected to the PCB substrate not by installing the core on the PBC substrate by soldering or using glue, but by attaching the metallic fixture on he PCB substrate and then connecting this metallic fixture with the core.

Figure 18:
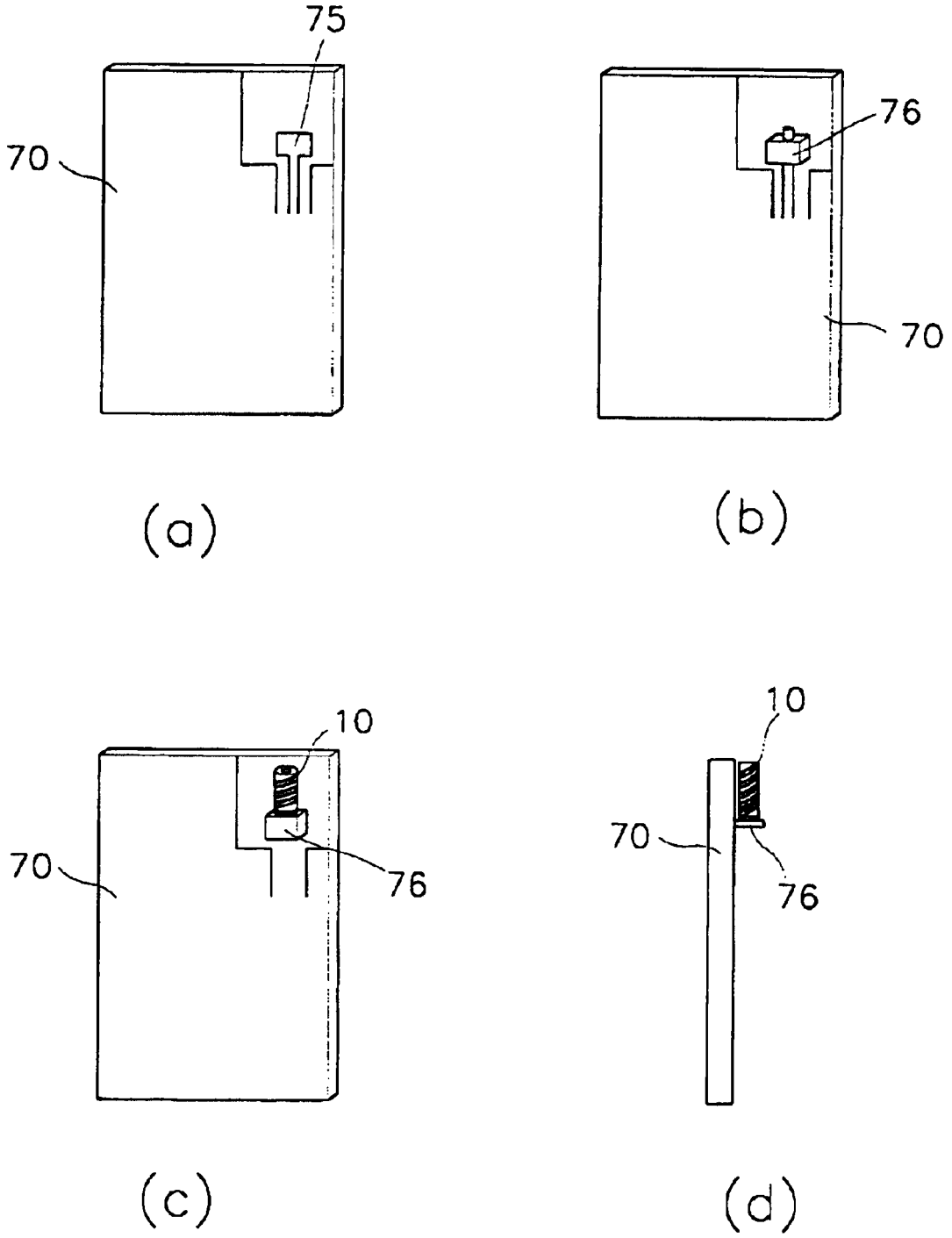
FIGS. 18(*a*)–18(*d*) show various views of a PCB substrate before and after a helical antenna is attached thereon according to a fifth preferred embodiment of the present invention.

FIG. 18 shows a various views of a PCB substrate before and after a helical antenna is attached thereon according to a fifth preferred embodiment of the present invention.

As shown in FIG. 18(*a*), an installation unit 75 having a land is formed on a particular part of the PCB substrate 70 in a manner identical to the third and fourth preferred embodiments of the present invention, and a metallic fixture 76 is installed on this land by a soldering process as shown in FIG. 18(*b*).

The core 10 is attached to this metallic fixture 76 by soldering the core 10, by electrically connecting the core with the metallic fixture 76 using conductive glue, or by forming a convex portion corresponding to the inner diameter of the core 10 on an upper part of the metallic fixture 76 as shown in FIG. 18(*c*).

FIG. 18(*d*) shows a side view of a state in which the core 10 is attached on the PCB substrate according to a fifth preferred embodiment of the present invention. As shown in the drawing, when the antenna is installed using the metallic fixture 76, the antenna is not protruded above the upper part of the PCB substrate, thereby enabling the antenna to be built within the communication device.

The helical antenna can be built within the mobile communication device as described in the third to fifth preferred embodiments of the present invention, and the components used for antenna signal processing can be reduced using the two built-in helical antennas.

Figure 19:
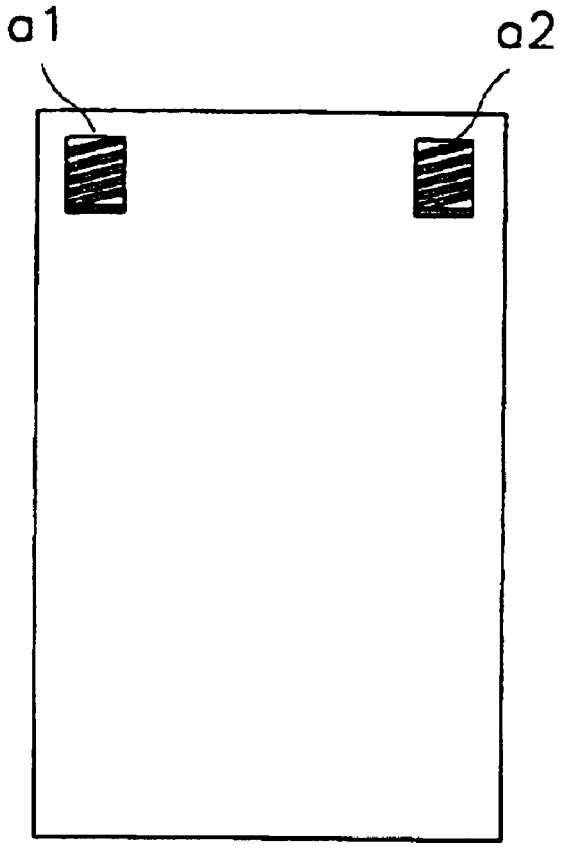
FIG. 19 shows a schematic plane view of a PCB substrate in which two helical antennas are installed according to a sixth preferred embodiment of the present invention.
Figure 20:
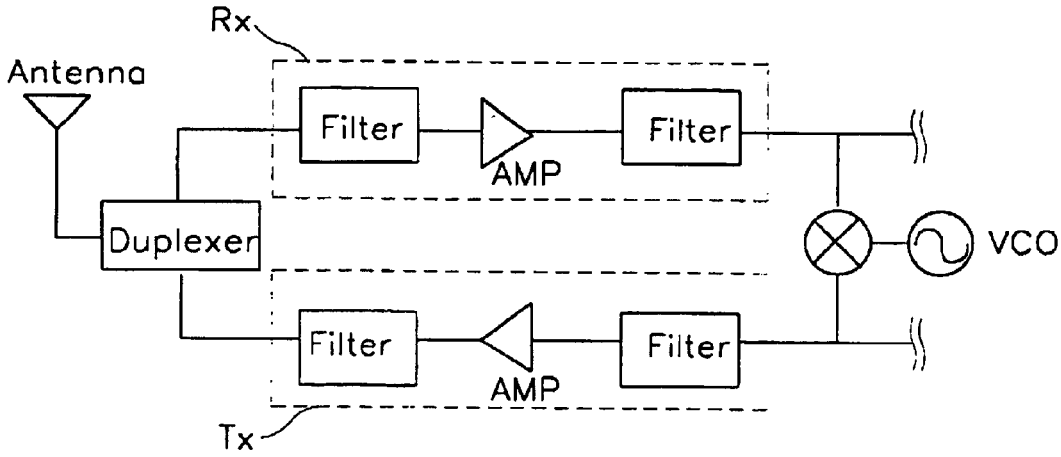
FIG. 20(*a*) shows a circuit diagram of a prior signal processor of the mobile station.
Figure 20:
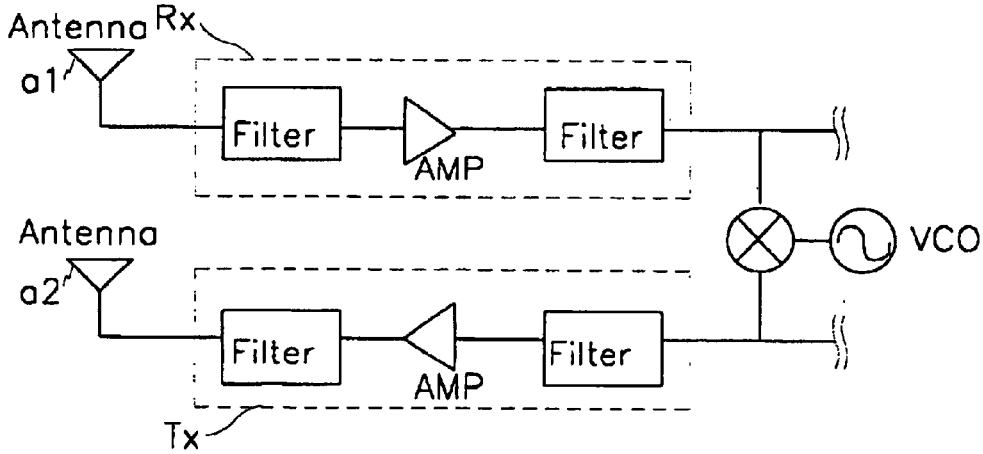

FIG. 19 shows a schematic plane view of a PCB substrate in which two helical antennas are installed according to a sixth preferred embodiment of the present invention. FIG. 20(*a*) shows a circuit diagram of a prior signal processor of the mobile station, and FIG. 20(*b*) shows a circuit diagram of a signal processor of a mobile station using two helical antennas according to the sixth preferred embodiment of the present invention.

As shown in FIG. 20(*a*), electronic wave signals received from the antenna are passed through a duplexer then provided to a receive (Rx) circuit and a transmit (Tx) circuit. At this time, the duplexer is used to prevent the signals provided to the Rx and Tx bands from being mixed. This duplexer is big in size, and costs of the components are expensive, but the duplexer is an essential component in the existing signal processor.

However, as shown in FIGS. 19 and 20(*b*), in the case of using two antennas according to the sixth preferred embodiment of the present invention, that is, in the case of using the Rx antenna a1 and the Tx antenna a2, the signals are provided to the respective Rx circuit and the Tx circuit through the corresponding Rx and Tx antennas. Therefore, the duplexer is not needed, and the circuit is simplified made less expensive.

If two prior external antennas are used, the two antennas are protruded so that they detract from appearance of the communication device and the device is easily damaged by external shocks. However, in the case of using the built-in antenna as shown in the sixth preferred embodiment of the present invention, since the antenna is not protruded external to the device as shown in FIG. 19, even when using the Rx and Tx antennas, such problems related to the appearance of the device and susceptibility to damage by external shocks are avoided. The device can also be made to compact sizes.

The positions of the antenna installed according to the sixth preferred embodiment of the present invention is not limited to that shown in FIG. 19, and the antenna can be positioned on any location of the PCB substrate.

In the above-described preferred embodiments of the present invention, two rollers are used to form the helical line on the surface of the core, and further, one or more than two rollers can be used to form the helical line.

Figure 21:
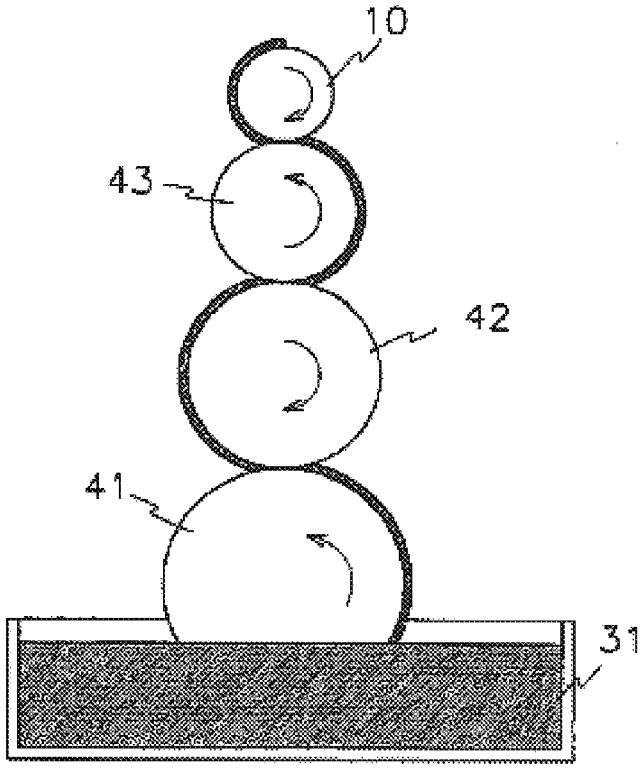
FIGS. 21(*a*)–21(*b*) show usage examples of the rollers according to the number of the numbers according to the preferred embodiment of the present invention.
Figure 21:
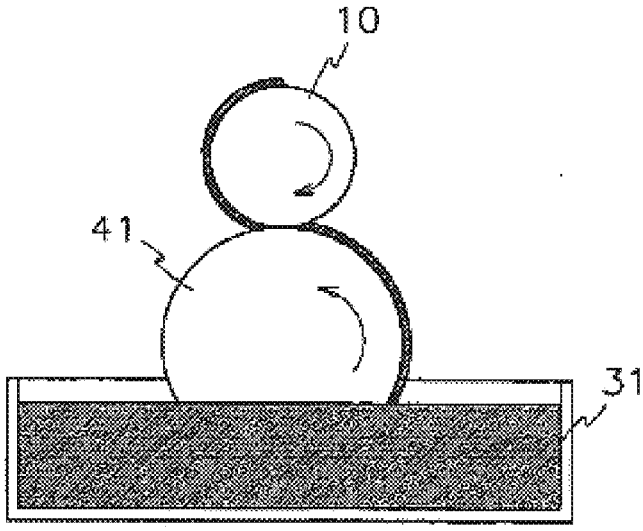

FIG. 21 shows examples of using the rollers according to the preferred embodiment of the present invention. As shown, in the case of using three rollers 41 to 43, the second roller is rotated in the opposite direction of the first roller 41, and the third roller 43 in the opposite direction of the second roller 42. In this case, the core 10 is rotated in the opposite direction of the third roller 43. In the case of using one roller, the core 10 is rotated in the opposite direction of the first roller 41. At this time, the greater the number of rollers, the less the amount of paste printed on the core.

Also, the width of the helical line formed on the surface of the core can be adjusted by modifying the shape and thickness of the roller contacted to the core.

Figure 22:
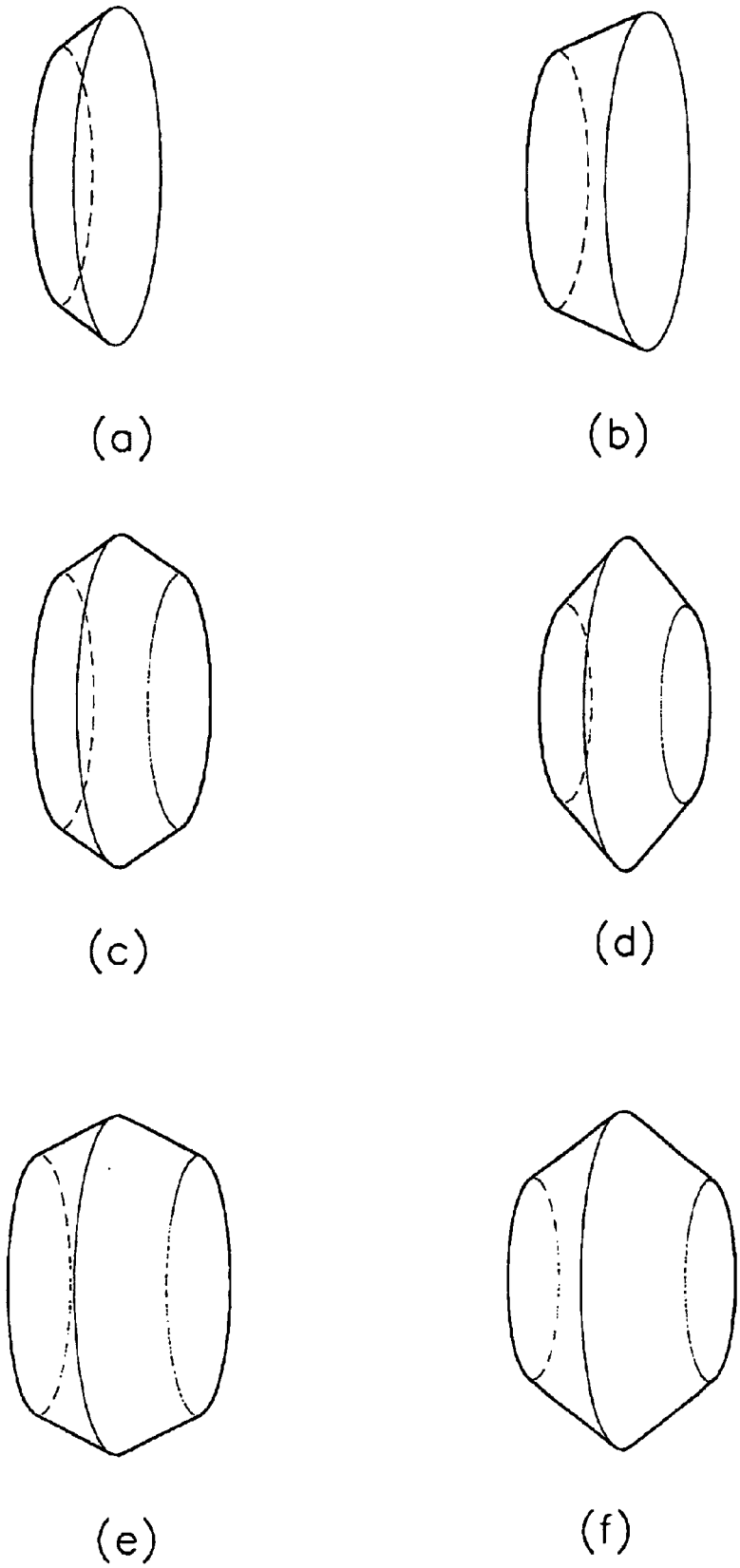
FIGS. 22(*a*)–22(*f*) show various forms of the rollers which can be used in the preferred embodiment of the present invention.

FIG. 22 shows various forms of the roller according to the preferred embodiment of the present invention. As shown in FIGS. 22(*a*) and (*b*), the width of the helical line formed on the core 10 can be changed by modifying the thickness of the roller or by sloping an outer circumference of the roller to a predetermined angle. It is also possible to make the external diameter of the roller greater than the diameter of the central part of the roller, thereby creating a predetermined angle between the outer part and the central part of the roller as shown in FIGS. 22(*c*) to (*f*), thereby varying the widths of the helical line printed on the core 10.

In the case the outer circumference of the roller contacted to the core is narrow, or the angle of the outer circumference or the angle between the outer surface and the central part of the roller is small, the width of the helical line formed on the surface of the core is reduced, whereas when the thickness of the outer circumference of the roller is increased, the width of the helical line formed on the surface of the core is enlarged. By selecting the angle of the outer circumference of the roller or the angle between the outer part of the roller and the central part, a helical line having a more precise width can be formed.

Also, by adjusting the gaps between the paste and the roller, between the rollers, and between the roller and the core, the width of the helical lines formed on the surface of the core can be changed. In this case, since the amount of the paste printed on the surface of the core is adjusted by the changes in the gaps, the widths of the helical line are changed.

In the above preferred embodiments of the present invention, while the roller and the core are rotated, the core is moved in the longitudinal direction so as to form the helical line on the surface of the core. However, the present invention is not restricted to these methods, and it is also possible to move the roller in the longitudinal direction while rotating the core and the roller so as to form the helical line on the surface of the core.

Figure 23:
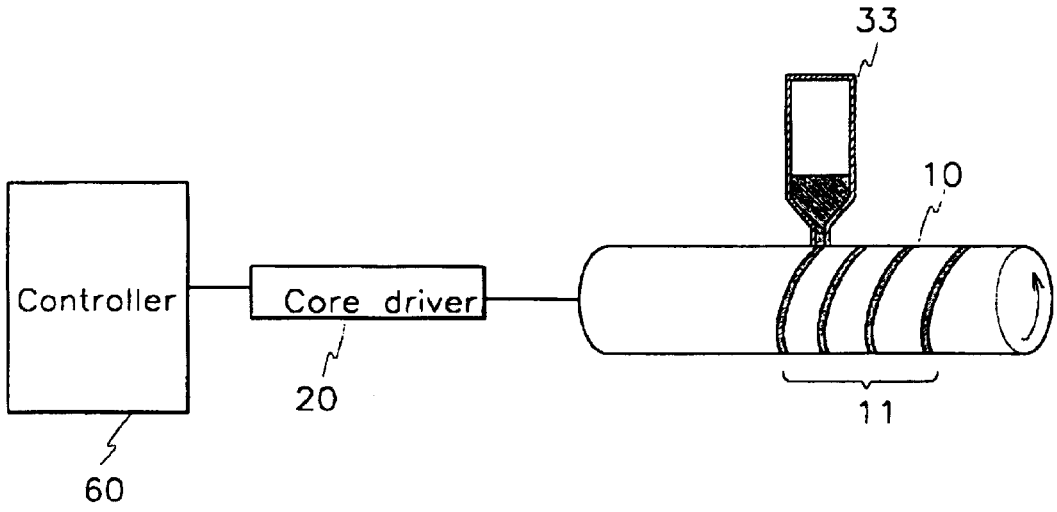
FIG. 23 shows a schematic view of a helical antenna manufacturing apparatus according to a seventh preferred embodiment of the present invention.

Also, differing from the above preferred embodiments, the helical line can be formed on the core 10 without using the roller. FIG. 23 shows a schematic view of a helical antenna manufacturing apparatus according to a seventh preferred embodiment of the present invention.

As shown in the drawing, the helical antenna manufacturing apparatus comprises a core 10; a core driver 20 driving the core 10; a dispenser 33 printing conductive paste on a surface of the core 10; and a controller 60 controlling the rotation of the core 10 and the movement of the core 10 in the longitudinal direction.

Conductive and viscous paste is filled in the dispenser 33, and the dispenser 33 outputs a predetermined amount of the paste according to the variation of internal pressure, and an outlet through which the paste is output is positioned on an outer surface of the core 10 in order for the outlet to be contacted to the surface of the core 10. In this preferred embodiment of the present invention, a device is provided which adjusts the internal pressure of the dispenser 33 to adjust the amount of the paste that is output from the dispenser 33. Since such a device is well known to persons skilled in the art, a detailed description of the device is not provided herein.

To form the helical line on the core 10, in the above-noted preferred embodiment of the present invention, the controller 60 controls the core driver 20 to rotate the core 10 and moves the same in the longitudinal direction, and at this time, the dispenser 33 outputs a predetermined amount of the paste on the surface of the core 10 so that the paste is printed on the surface of the core 10 and the helical line 11 is formed.

As with the first to fourth preferred embodiments of the present invention, the pitches and the lengths of the helical line 11 formed on the surface of the core 10 can be modified by adjusting the rpm and the rotational duration of the core 10 according to the working frequency bands of the antenna.

That is, since the core 10 is moved for each step with a different moving speed according to the working frequency bands of the antenna and the number of the bands, a plurality of the helical lines 11 and 12 having different pitches are formed. At this time, when differently setting the rotational durations of the core 10 for the respective steps, a plurality of the helical lines having different lengths can be formed.

Figure 24:
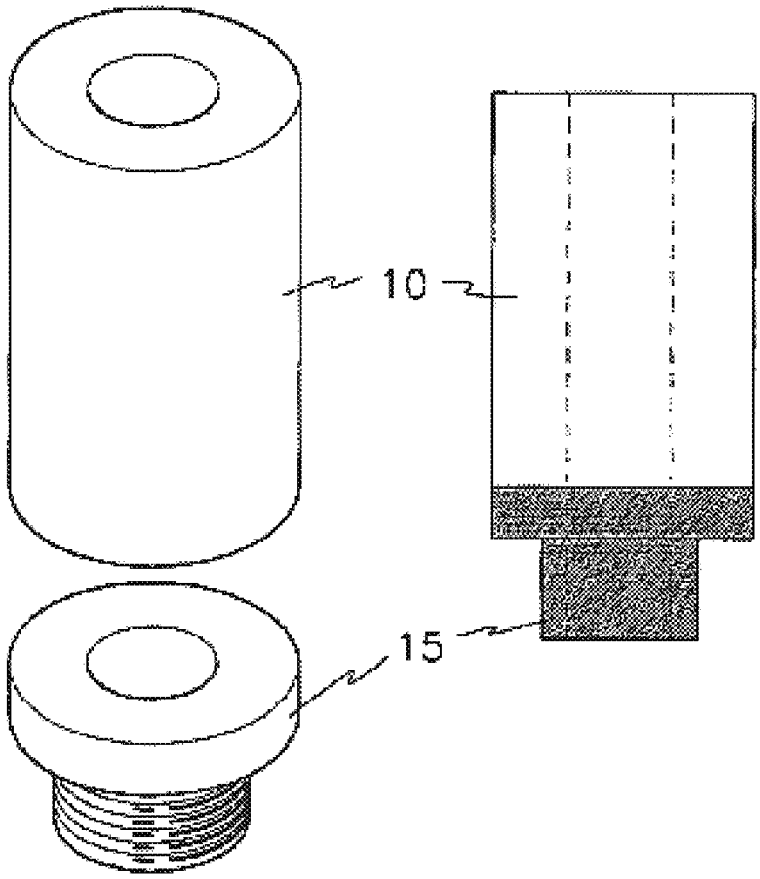
FIG. 24 shows a perspective view of a helical antenna according to another preferred embodiment of the present invention.

Also, according to the above-described preferred embodiments of the present invention, a cavity can be formed within the inner part of the core 10 so that a whip antenna can be provided penetrating through the inner part of the core 10 on which the helical line is formed. FIG. 24 shows the helical antenna in which the cavity is formed within the inner part of the core 10. As shown, when the helical antenna is formed, the helical antenna according to the preferred embodiment of the present invention can be used as a stubby antenna or a retractable antenna.

To improve the characteristics of the antenna, a gilding process can be performed on the core by an electrolytic gilding process. At this time, the material used for gilding can be Ag, Au, Ni, and Sn.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A helical antenna manufacturing apparatus, comprising:

a core made of insulative material;

a first roller printing a conductive and viscous paste on a surface of the core to form a helical line;

a roller driver rotating the first roller;

a core driver rotating the core and moving the same in a longitudinal direction; and a controller controlling the roller driver and the core driver to control an rpm of the core, a longitudinal moving speed of the core, and the rpm of the roller, the longitudinal moving speed being set according to working frequency bands of the antenna.

2. The apparatus of claim 1, wherein the apparatus further comprises:

a paste box containing the paste; and a paste provider comprising a paste injector injecting the paste into the paste box.

3. The apparatus of claim 2, wherein the apparatus further comprises one or more second rollers contacted to the paste in the paste box and rotated, and providing the paste to the first roller.

4. The apparatus of claim 1, wherein an outer circumference of the first roller is sloped at a predetermined angle.

5. The apparatus of claim 1, wherein a diameter of a central part of the first roller is greater than a diameter of an outer part of the first roller.

6. The apparatus of claim 1, wherein the apparatus further comprises:

a core provider providing the core to a position to be contacted with the first roller; and a drier drying the core on which the helical line is formed.

7. A helical antenna manufacturing apparatus, comprising:

a core made of insulative material;

a dispenser comprising a conductive and viscous paste, and printing the paste on a surface of the core to form a helical line;

a core driver rotating the core and moving the same in a longitudinal direction; and a controller controlling the core driver to control the rpm of the core and a longitudinal moving speed of the core, the longitudinal moving speed being set according to working frequency bands of the antenna.

8. A helical antenna manufacturing apparatus, comprising:

a core made of insulative material;

a roller printing a conductive and viscous paste on a surface of the core to form a helical line unit comprising a first helical line of a first frequency band and a second helical line of a second frequency band;

a roller driver rotating the roller;

a core driver rotating the core and moving the same in a longitudinal direction of the core; and a controller controlling the roller driver and the core driver to control an rpm of the core and an rpm of the roller, and sequentially controlling the core driver according to a first moving speed which is set according to the first frequency band at which the antenna is operated and according to a second moving speed which is set according to the second frequency band.

9. The apparatus of claim 8, wherein the controller controls the core driver during a first set time according to the first moving speed, and then during a second set time according to the second moving speed, and the first and the second set times are changed according to working frequency bands of the antenna.

10. A helical antenna manufacturing apparatus, comprising:

a core made of insulative material;

a dispenser comprising a conductive and viscous paste, and printing the paste on a surface of the core to form a helical line unit including a first helical line of a first frequency band and a second helical line of a second frequency band;

a core driver rotating the core and moving the same in a longitudinal direction; and a controller controlling the core driver to control the rpm of the core and sequentially controlling the core driver according to a first moving speed which is set according to the first frequency band at which the antenna is operated and according to a second moving speed which is set according to the second frequency band.

11. A helical antenna manufacturing method, comprising the steps of:

printing a helical line unit, including a first helical line of a first frequency band and a second helical line of a second frequency band, on a surface of a core which is insulation;

dipping a part of the core in a conductive paste to form a terminal;

connecting a feeder to the terminal of the core, the feeder being electrically connected to an external circuit; and sealing an outer part of the core with a cover of insulation.

12. In an antenna which is installed on a circuit board within a communication device, a helical antenna, comprising:

a core made of insulative material;

a conductive line formed over an entire surface of the core in a helical configuration; and a feeder connected to the conductive line, formed on a lower part of the core, and electrically connected to the circuit board and the conductive line and the feeder being made of conductive paste.

13. The antenna of claim 12, wherein the core is made of insulative material and includes a cavity formed within the core, and an insulation unit having a convex portion is formed on the circuit board of the communication device, the size of the convex corresponding to an inner diameter of the core and the core being inserted on the convex portion of the insulation unit to be installed on the circuit board.

14. The antenna of claim 12, wherein an insulation unit having a land is formed on the circuit board of the communication device, and the size of the land corresponds to an inner diameter of the core, the core being installed perpendicularly to the land of the insulation unit.

15. The antenna of claim 12, further comprising a second helical antenna installed on the circuit board within the communication device.

16. In a method for manufacturing an antenna which is installed on a circuit board within a communication device, a helical antenna manufacturing method, comprising the steps of:

(a) printing a conductive line on a surface of a core as a helical pattern;

(b) dipping a part of the core in a conductive paste to form a feeder; and (c) installing the core on an internal circuit board of the communication device.

17. The method of claim 16, wherein the method further comprises a step of forming an installation unit, which has a convex portion having a size corresponding to an inner diameter of the core, on the circuit board of the communication device in the case a cavity is formed in the inner part of the core, and in the step (c), the core is inserted on the convex of the installation unit to be installed on the circuit board.

18. The method of claim 16, wherein the feeder of the core is installed on the circuit board by a soldering process.

19. The method of claim 16, wherein the feeder of the core is installed on the circuit board by using conductive glue.

20. The method of claim 16, wherein in the step (c), after a metallic fixture is installed on the circuit board by soldering or using conductive glue, the core is electrically contracted to the metallic fixture.

* * * * *